US008533894B2

(12) United States Patent
Watanabe et al.

(10) Patent No.: US 8,533,894 B2
(45) Date of Patent: Sep. 17, 2013

(54) SCALP WASHING DEVICE

(75) Inventors: Toshio Watanabe, Sumida-ku (JP); Keiji Yoshii, Chuo-ku (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/387,507

(22) PCT Filed: Jul. 29, 2010

(86) PCT No.: PCT/JP2010/062771

§ 371 (c)(1),
(2), (4) Date: Jan. 27, 2012

(87) PCT Pub. No.: WO2011/013739

PCT Pub. Date: Feb. 3, 2011

(65) Prior Publication Data

US 2012/0124764 A1 May 24, 2012

(30) Foreign Application Priority Data

Jul. 29, 2009 (JP) ..... 2009-176602
Jul. 28, 2010 (JP) ..... 2010-168839

(51) Int. Cl.
*A46B 3/22* (2006.01)

(52) U.S. Cl.
USPC ..... 15/207.2; 15/186; 15/187; 15/188

(58) Field of Classification Search
USPC ..... 15/186, 187, 207.2; 132/107, 112, 132/113, 116, 125, 126, 141, 142; 601/134–136
See application file for complete search history.

(56) References Cited

U.S. PATENT DOCUMENTS 3,470,575 A * 10/1969 Gordon et al. ..... 15/38
3,604,431 A * 9/1971 Pearson et al. ..... 132/137
5,327,611 A * 7/1994 Balster et al. ..... 15/176.4
5,564,153 A * 10/1996 Lange ..... 15/187
6,110,132 A * 8/2000 Kurpieski ..... 601/136
7,530,752 B2 * 5/2009 Gueret ..... 401/129

(Continued)

FOREIGN PATENT DOCUMENTS

JP 6 77553 11/1994
JP 9 173152 7/1997
JP 2007 282681 11/2007

OTHER PUBLICATIONS

International Search Report issued on Aug. 31, 2010 in PCT/JP10/062771 filed on Jul. 29, 2010.

(Continued)

*Primary Examiner* — Monica Carter
*Assistant Examiner* — Michael Jennings
(74) *Attorney, Agent, or Firm* — Oblon, Spivak, McClelland, Maier & Neustadt, L.L.P.

(57) ABSTRACT

A scalp washing device includes a base and projections for washing projected from a brush surface of the base. Each of the projections includes a root portion on a side of the base having a circular shape in cross-section, a middle portion including a tip surface having a flattened shape in cross-section, and at least a pair of conical tip projections each having a tip chamfered to have a curved surface and provided on the tip surface. The middle portion has a cross-sectional shape changing from a circular shape to a flattened shape from a side of the root portion to a side of the tip surface.

11 Claims, 35 Drawing Sheets

(56) References Cited

U.S. PATENT DOCUMENTS

| | | | | |
|---|---|---|---|---|
| D632,486 | S * | 2/2011 | Watanabe et al. | D4/136 |
| D632,487 | S | 2/2011 | Watanabe et al. | |
| 2002/0147418 | A1* | 10/2002 | Huang | 601/137 |
| 2005/0055788 | A1* | 3/2005 | Chang et al. | 15/186 |
| 2005/0107017 | A1* | 5/2005 | Fioratti | 451/526 |
| 2008/0234611 | A1* | 9/2008 | Sakai et al. | 601/95 |
| 2009/0182249 | A1* | 7/2009 | Sakai et al. | 601/136 |

OTHER PUBLICATIONS

International Preliminary Report on Patentability and Written Opinion issued Feb. 16, 2012, in PCT/JP2010/062771 filed Jul. 29, 2010.

* cited by examiner

FIG. 61

| | Example 1 | Comparative Example 1 | Comparative Example 2 | Comparative Example 3 |
|---|---|---|---|---|
| Evaluation 1 (Average of n=5) | 9.3 | 7.3 | 4.0 | 6.7 |
| Evaluation 2 (Average of n=5) | 9.3 | 9.0 | 3.7 | 6.7 |
| Evaluation 3 (Average of n=5) | 8.7 | 8.3 | 4.3 | 6.7 |
| Evaluation 4 (Average of n=5) | 8.3 | 4.0 | 4.0 | 6.3 |
| Evaluation 5 (Average of n=5) | 9.0 | 4.3 | 3.0 | 5.7 |
| Evaluation 6 (Average of n=5) | 9.7 | 8.3 | 7.0 | 7.0 |
| Total | 54.3 | 41.3 | 26.0 | 39.0 |
| Average | 9.1 | 6.9 | 4.3 | 6.5 |
| Standard Deviation | 0.5 | 2.2 | 1.4 | 0.5 |

SCALP WASHING DEVICE

TECHNICAL FIELD

The present invention relates to a scalp washing device used for washing skin and pores of scalp.

BACKGROUND ART

Various types of scalp washing brushes (scalp washing devices) used at the time of washing hair are known. A scalp washing brush described in Patent Literature 1 has a plurality of projections made of resin having an approximately conical shape provided on the brush surface of the base, in which the tips of the projections flexibly bend by coming into contact with scalp, thereby washing skin and pores of the scalp.

CITATION LIST

Patent Literature

Patent Literature 1: Japanese Utility Model Application Laid-Open Publication No. H06-77553

SUMMARY OF INVENTION

Technical Problem

However, in the related scalp washing brush described above, since the root portions of the projections having an approximately conical shape are deformable to easily bend, hair prevents the tips of the projections from coming into contact with skin and pores of the scalp. As a result, skin oil excreted from the pores is not easily removed and cleansed sufficiently.

It is an object of the present invention to provide a scalp washing device capable of effectively removing skin oil excreted from pores of scalp to surely cleanse skin and pores.

Solution to Problem

An aspect of the present invention is a scalp washing device comprising: a base; and projections made of elastomer resin and projected from a brush surface of the base, wherein each of the projections includes a root portion on the base having a circular shape in cross-section, a middle portion including a tip surface having a flattened shape in cross-section, and the middle portion has a cross-sectional shape changing from a circular shape to a flattened shape from the middle portion on the root portion to the tip surface.

Each of the projections may include a conical tip projection having a tip chamfered to have a curved surface and provided on the tip surface of the middle portion.

According to the above-described configuration, since the root portions of the projections are hard to be deformed so as not to easily bend, the respective tip projections of the projections surely come into contact with skin and pores of the scalp even when hair becomes an obstacle at the time of washing. Accordingly, the respective tip projections are deformed to reliably remove skin oil excreted from the pores and surely wash the pores and skin by the tips of the tip projections.

The projections may be arranged in plural and parallel at intervals from a center of the brush surface of the base toward a periphery of the base, and a height of the projections at the tip projections located at an outer side of each row of the projections may be higher than a height of the projections at the tip projections located at an inner side of each row of the projections.

According to the above-described configuration, all the tips of the tip projections of the respective projections can be pressed surely and easily against the curved skin of the scalp to remove skin oil and cleanse pores effectively.

The projections may be projections for washing and the scalp washing device may further comprise projections for scraping off skin oil and projections for massaging alternately arranged between the respective rows of the projections.

According to the above-described configuration, the scalp washing device can massage the scalp effectively as well as removing skin oil and cleansing the pores efficiently.

The base may include a base body having a handle, and a base plate having through-holes and attached to an opening formed on a bottom of the base body, the projections may be provided on a bottom board sandwiched between the base body and the base plate, the root portions of the projections may be configured to be inserted into the corresponding through-holes of the base plate, and the projections may be projected beyond a lower surface of the base plate.

According to the above-described configuration, the number of parts composing the scalp washing device can be reduced to the minimum. Accordingly, the whole structure can be simplified and a reduction in cost can also be achieved.

The handle may have a flat portion at a rear end of the handle and be provided to form an eave shape via a pillar portion from one end to a middle of an upper surface of the base body defining a curved convex surface, and the base body may have a flat portion formed at another end of the upper surface.

The flat portion at the another end of the upper surface of the base body may be formed directly on the upper surface.

The base body may have a projecting portion formed at the another end of the upper surface, and the flat portion at the another end of the upper surface of the base body may be formed on the projecting portion.

According to the above-described configuration, an aesthetic appearance of the base body is improved, and the base stands by itself while the respective projections face upward, so that deformation and damage of the projections during the unused state are prevented.

The bottom board may be made of elastomer resin, and the projections may be integrally formed on the bottom board.

BRIEF DESCRIPTION OF DRAWINGS

FIG. 61 is an explanation diagram of each evaluation comparing Example 1 with respective Comparative Examples 1 to 3 shown as a table.

DESCRIPTION OF EMBODIMENTS

Hereinafter, embodiments of the present invention will be explained with reference to the drawings.

First Embodiment

Figure 1:
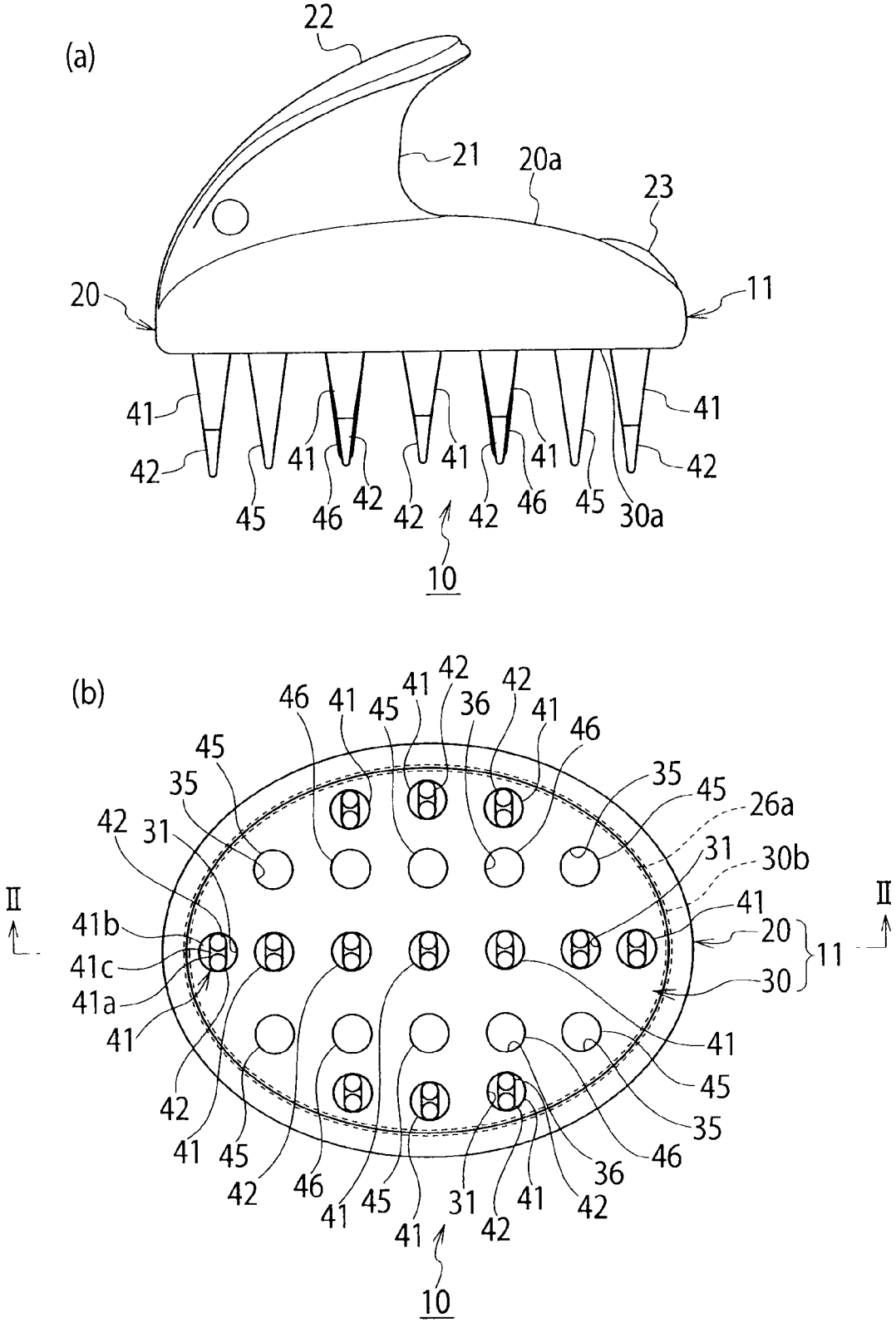
FIG. 1(*a*) is a front view showing a scalp washing device according to a first embodiment of the present invention, and FIG. 1(*b*) is a bottom surface view of the scalp washing device.
Figure 2:
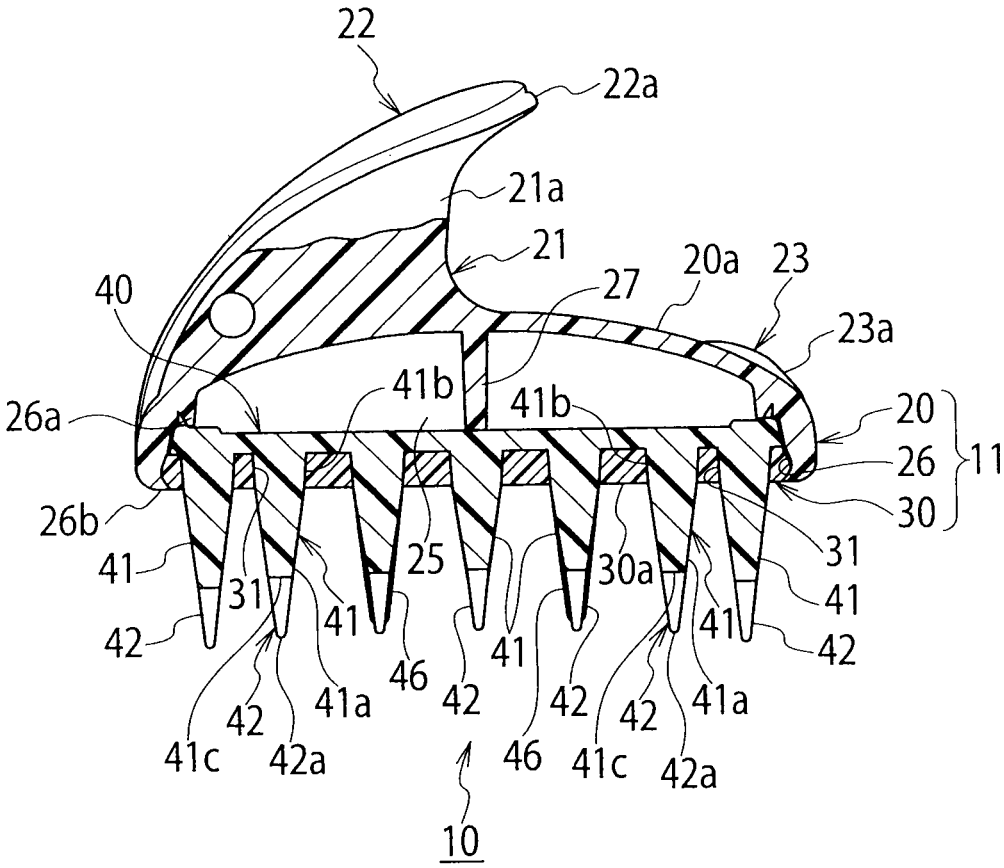
FIG. 2 is a cross-sectional view of the scalp washing device taken along the line II-II in FIG. 1(*b*).
Figure 3:
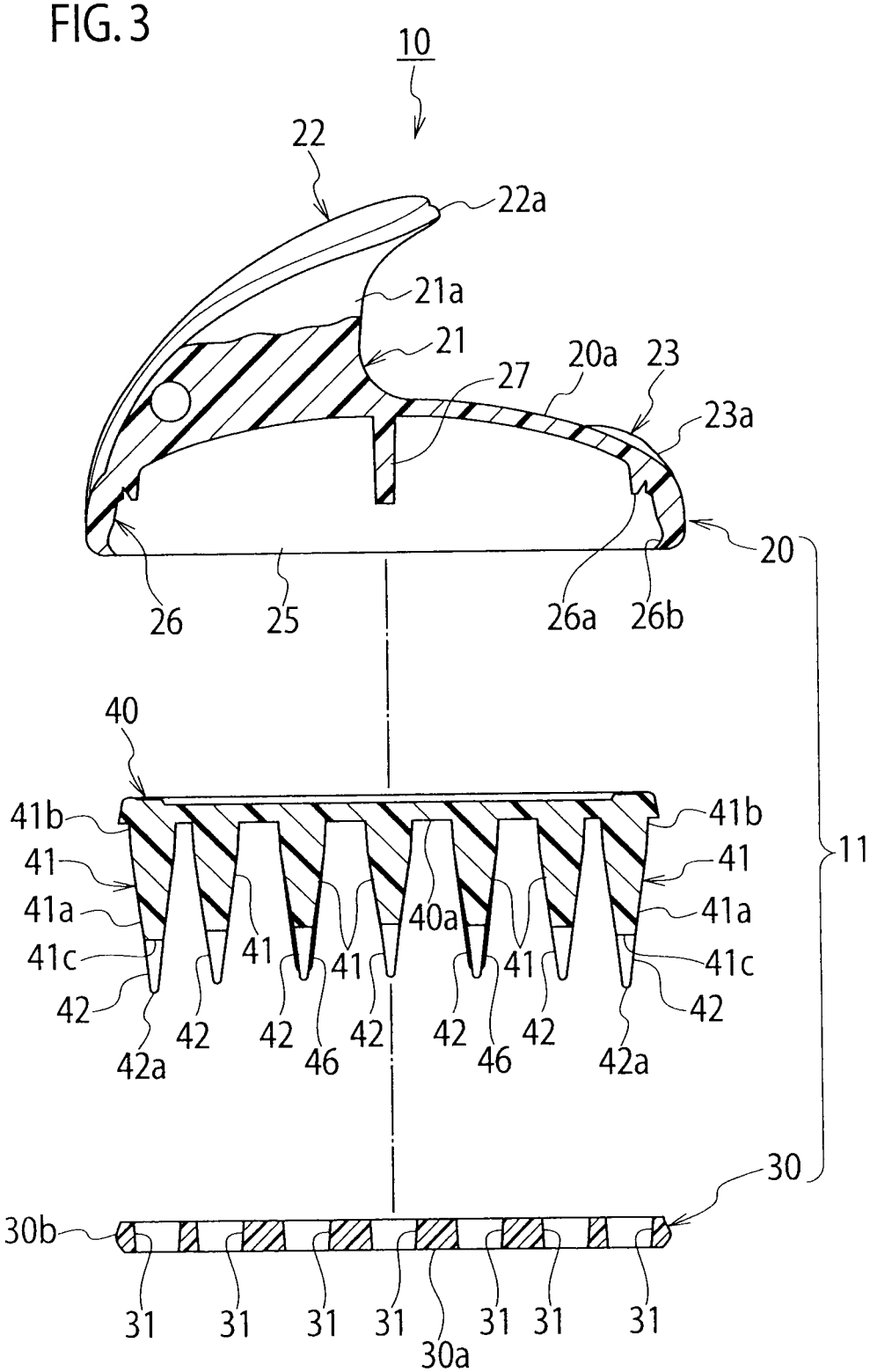
FIG. 3 is an exploded cross-sectional view of the scalp washing device taken along the line II-II in FIG. 1(*b*).
Figure 4:
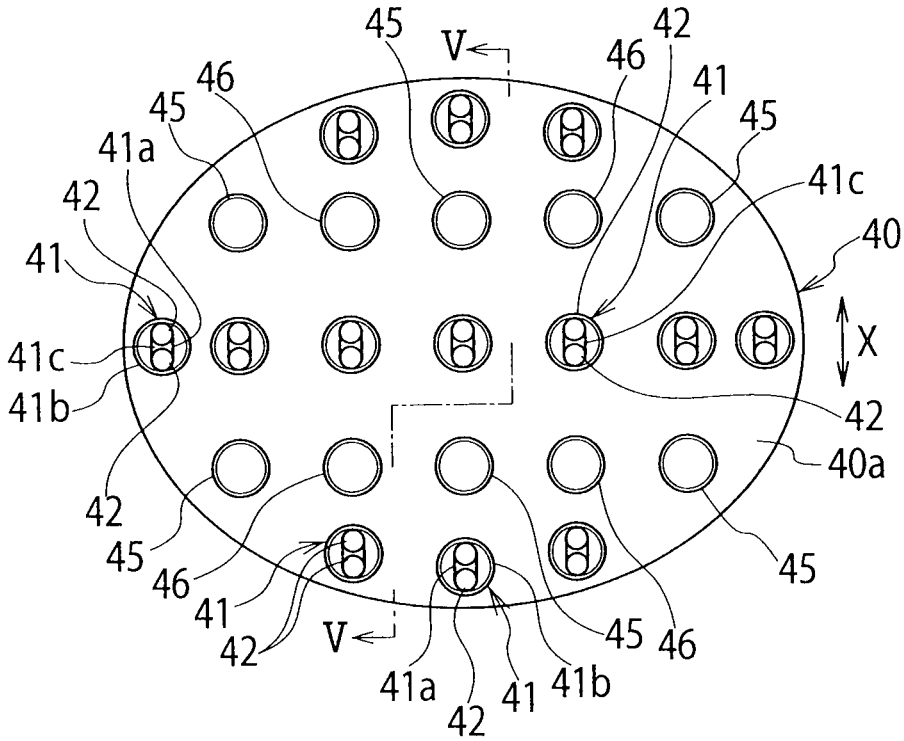
FIG. 4 is a bottom surface view of a bottom board made of elastomer resin used for the scalp washing device.
Figure 5:
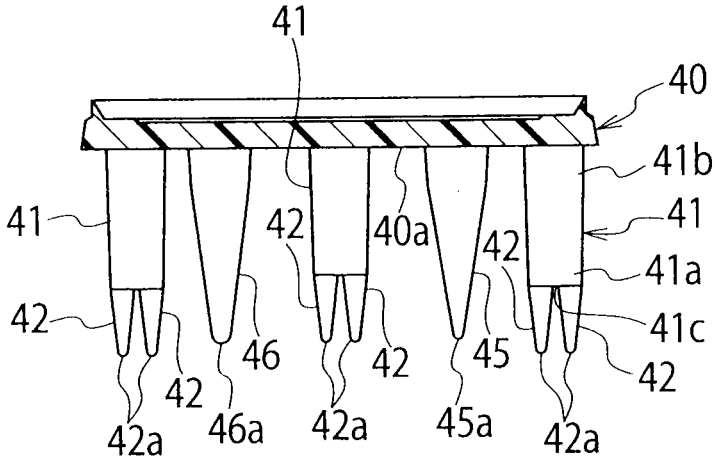
FIG. 5 is a cross-sectional view taken along the line V-V in FIG. 4.
Figure 6:
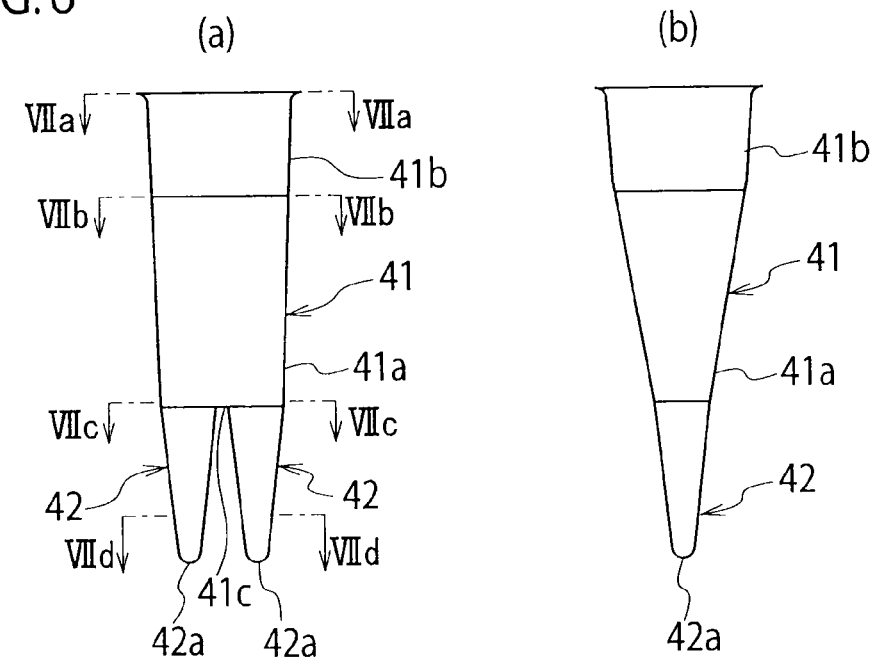
FIG. 6(*a*) is a side view of a spatular projection projected from the bottom board, and FIG. 6(*b*) is a front view of the spatular projection.
Figure 7:
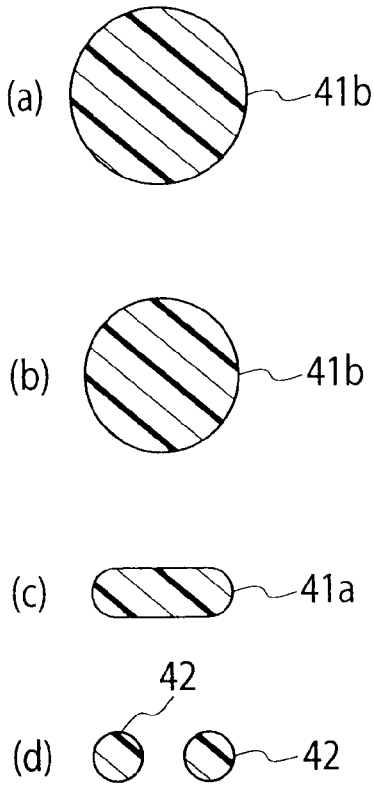
FIG. 7(*a*) is a cross-sectional view taken along the line VIIa-VIIa in FIG. 6(*a*), FIG. 7(*b*) is a cross-sectional view taken along the line VIIb-VIIb in FIG. 6(*a*), FIG. 7(*c*) is a cross-sectional view taken along the line VIIc-VIIc in FIG. 6(*a*), and FIG. 7(*d*) is a cross-sectional view taken along the line VIId-VIId in FIG. 6(*a*).
Figure 8:
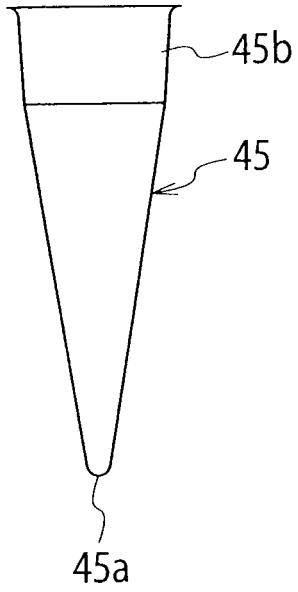
FIG. 8 is a front view of a projection for scraping off skin oil projected from the bottom board.
Figure 9:
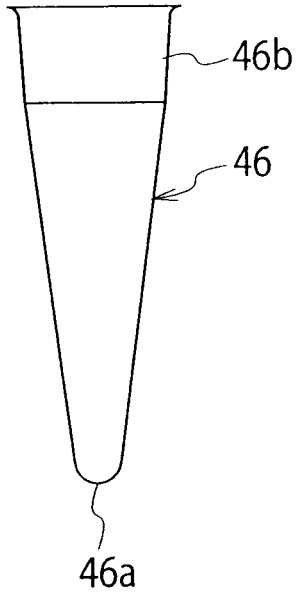
FIG. 9 is a front view of a projection for massaging projected from the bottom board.
Figure 10:
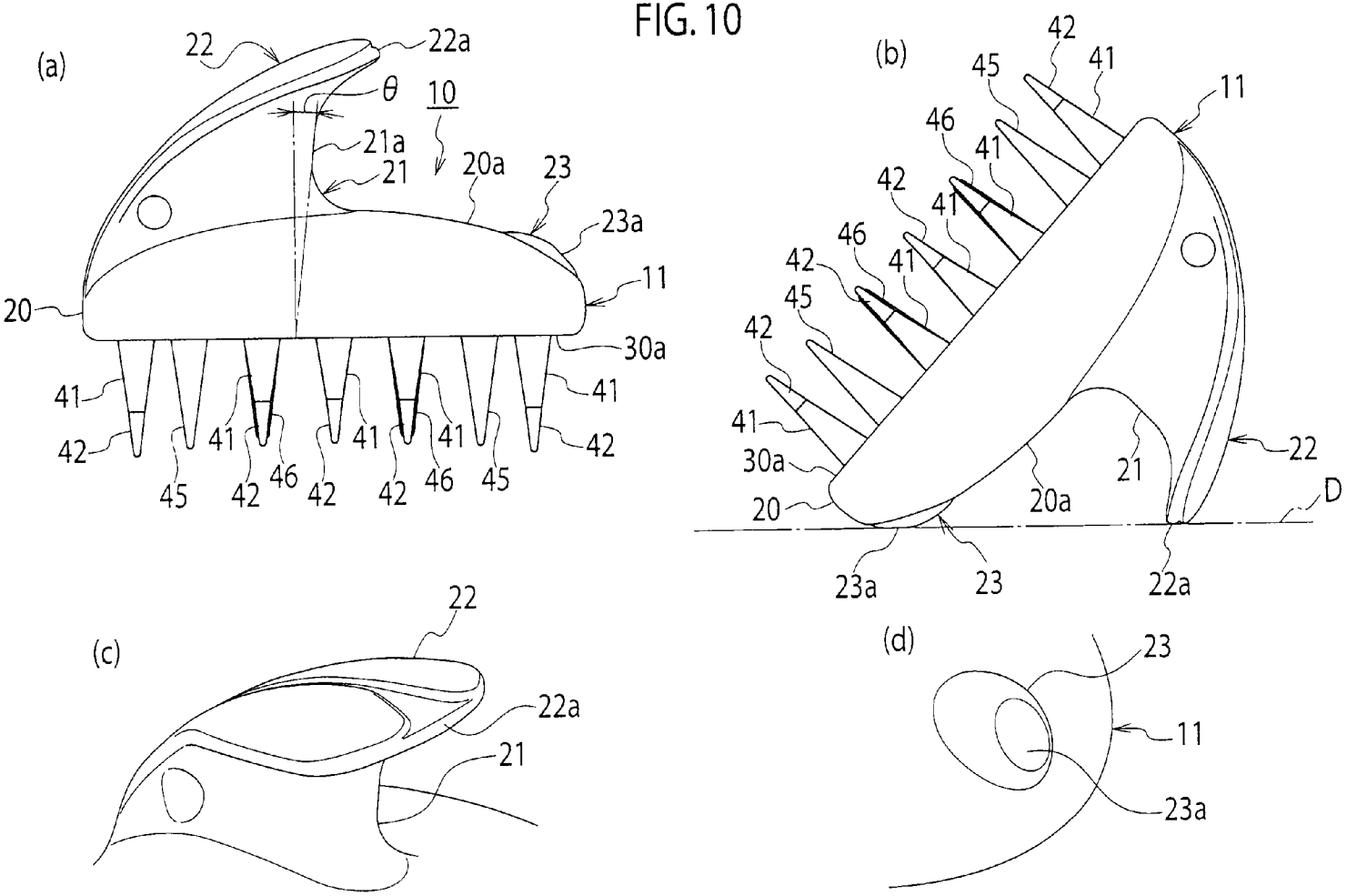
FIG. 10(*a*) is a front view illustrating a handle of the scalp washing device, FIG. 10(*b*) is a view illustrating a state in which the scalp washing device stands by itself by using the handle and a tail portion, FIG. 10(*c*) is a perspective view of the handle, and FIG. 10(*d*) is a perspective view of the tail portion.

FIG. 1(*a*) is a front view showing a scalp washing device 10 according to an embodiment of the present invention, FIG. 1(*b*) is a bottom surface view of the scalp washing device 10, FIG. 2 is a cross-sectional view of the scalp washing device 10, FIG. 3 is an exploded cross-sectional view of the scalp washing device 10, FIG. 4 is a bottom surface view of a bottom board 40 made of elastomer resin, for example, used for the scalp washing device 10, FIG. 5 is a cross-sectional view taken along the line V-V in FIG. 4, FIG. 6(*a*) is a side view of a spatular projection 41 projected from the bottom board 40, FIG. 6(*b*) is a front view of the spatular projection 41, FIG. 7(*a*) is a cross-sectional view taken along the line VIIa-VIIa in FIG. 6(*a*), FIG. 7(*b*) is a cross-sectional view taken along the line VIIb-VIIb in FIG. 6(*a*), FIG. 7(*c*) is a cross-sectional view taken along the line VIIc-VIIc in FIG. 6(*a*), FIG. 7(*d*) is a cross-sectional view taken along the line VIId-VIId in FIG. 6(*a*), FIG. 8 is a front view of a projection for scraping off skin oil projected from the bottom board 40, FIG. 9 is a front view of a projection for massaging projected from the bottom board 40, FIG. 10(*a*) is a front view illustrating a handle 22 of the scalp washing device 10, FIG. 10(*b*) is a view illustrating a state in which the scalp washing device 10 stands by itself by using a handle 22 and a tail portion 23, FIG. 10(*c*) is a perspective view of the handle 22, and FIG. 10(*d*) is a perspective view of the tail portion 23.

Figure 11:
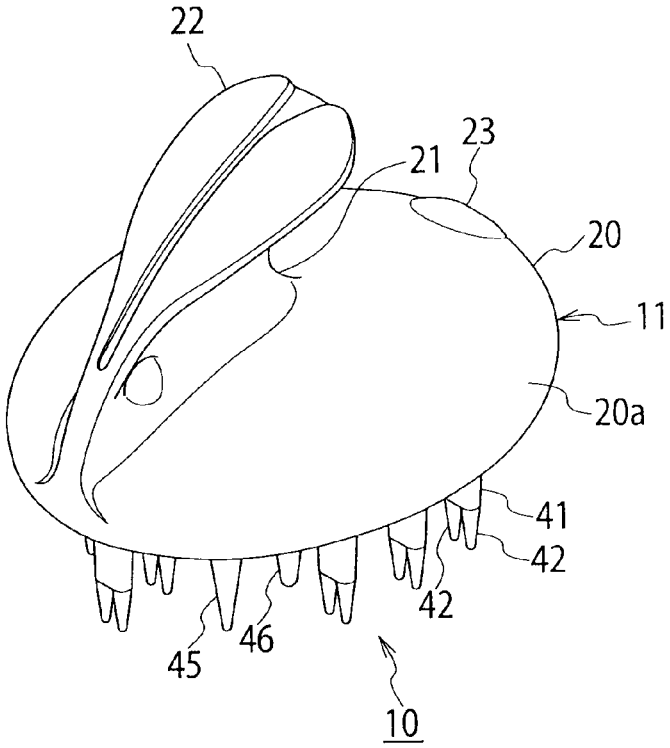
FIG. 11 is a front perspective view of the scalp washing device.
Figure 12:
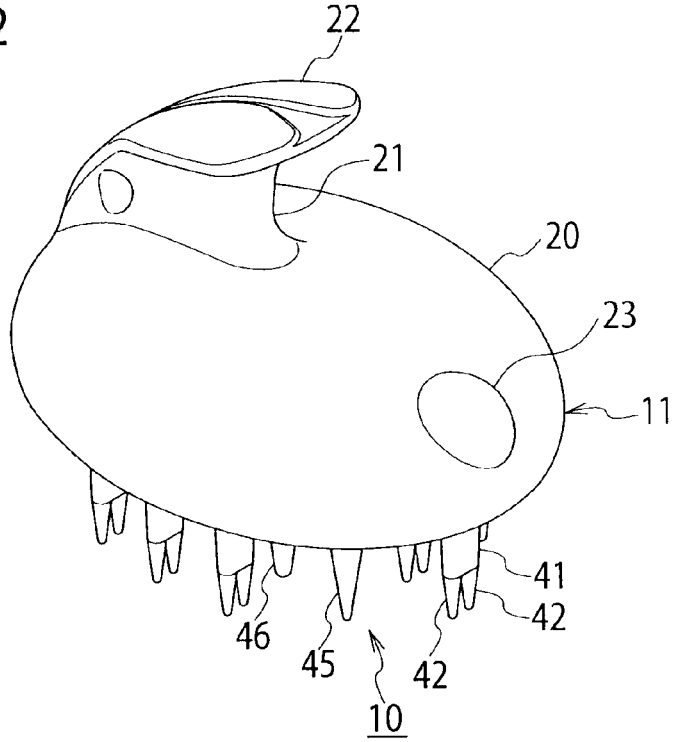
FIG. 12 is a rear perspective view of the scalp washing device.
Figure 13:
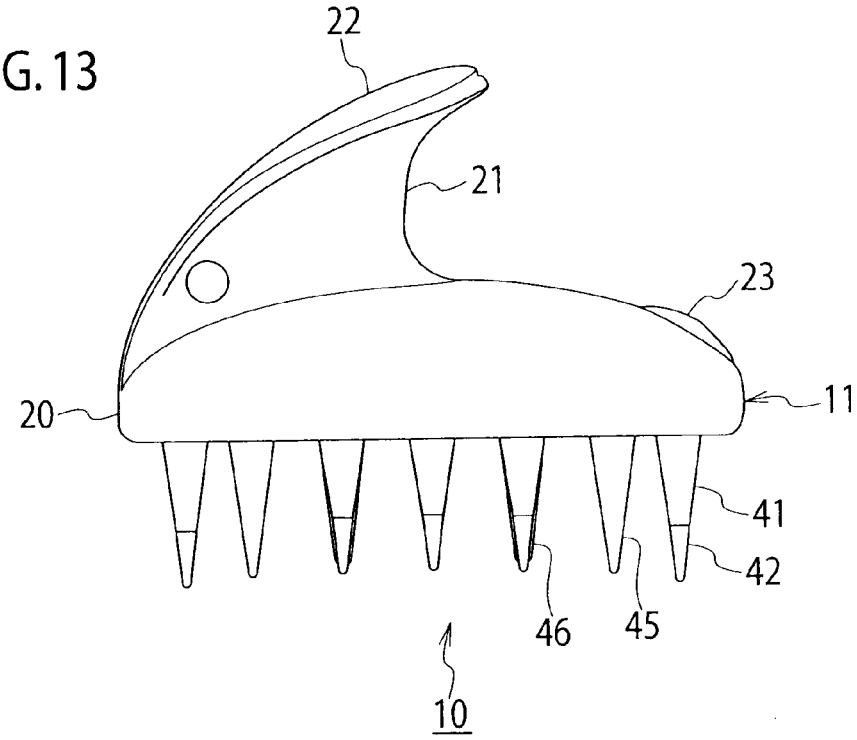
FIG. 13 is a front view of the scalp washing device.
Figure 14:
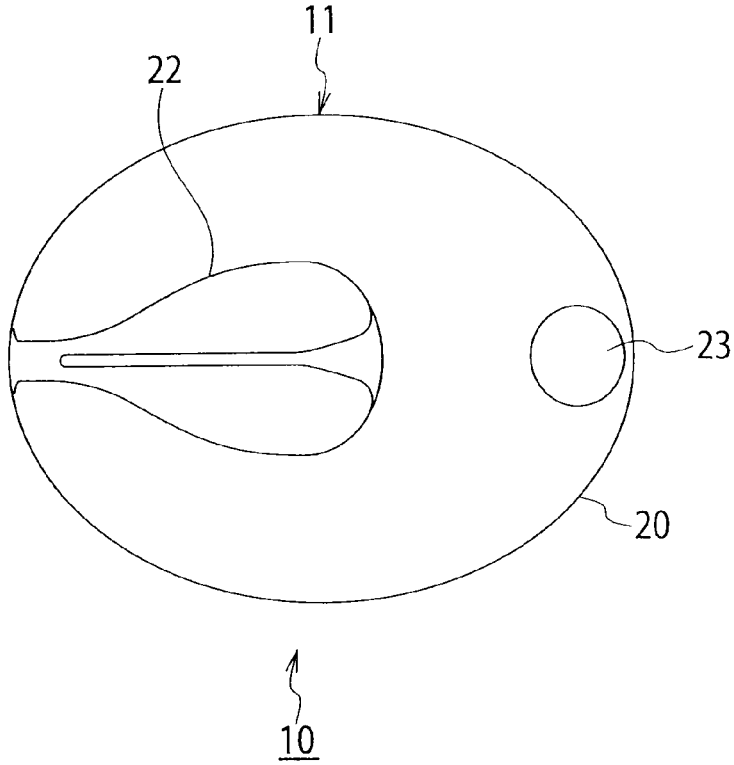
FIG. 14 is a plan view of the scalp washing device.
Figure 15:
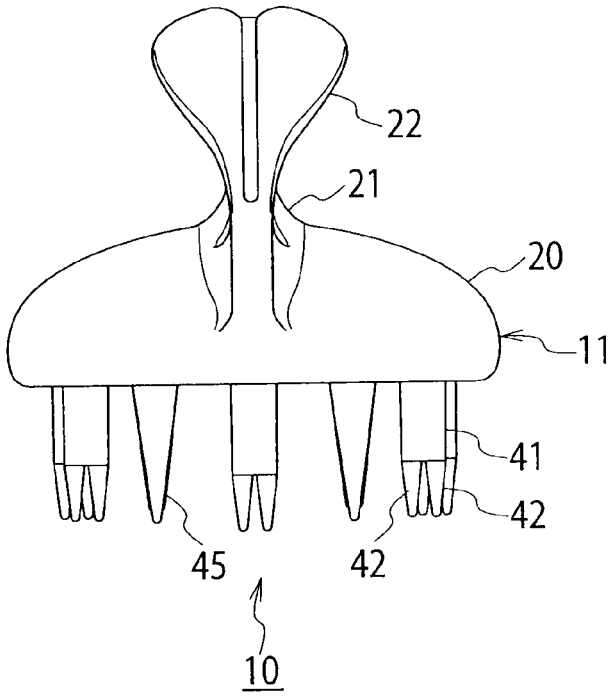
FIG. 15 is a left side view of the scalp washing device.
Figure 16:
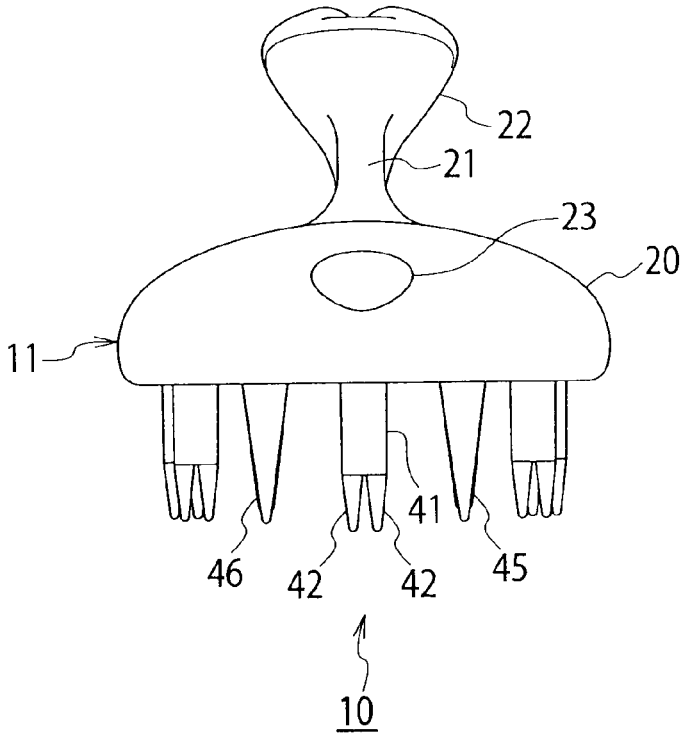
FIG. 16 is a right side view of the scalp washing device.
Figure 17:
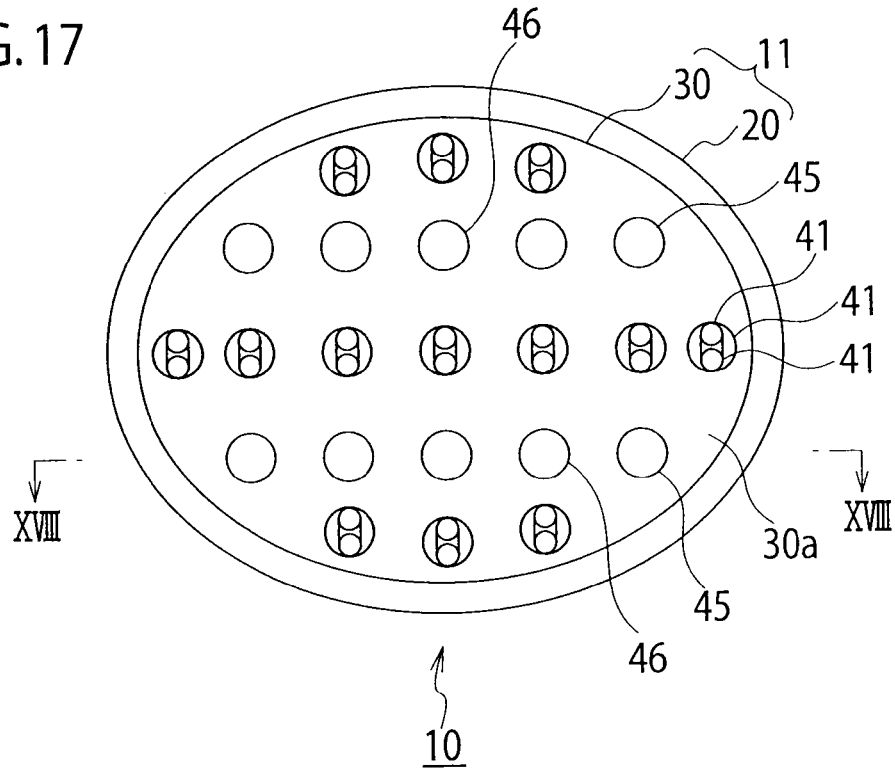
FIG. 17 is a bottom surface view of the scalp washing device.
Figure 18:
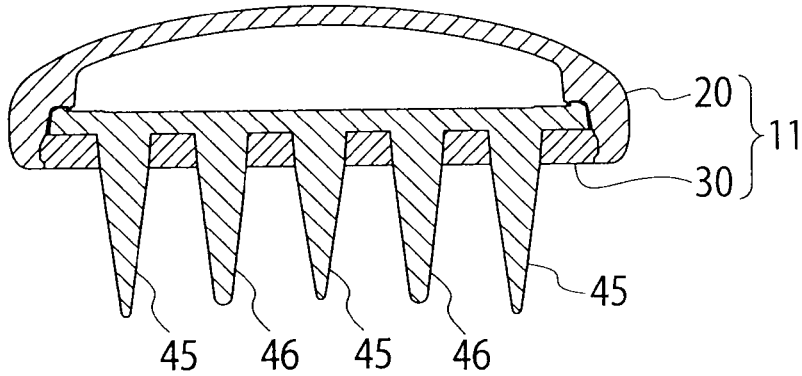
FIG. 18 is a cross-sectional view taken along the line XVIII-XVIII in FIG. 17.

FIG. 11 is a front perspective view of the scalp washing device 10, FIG. 12 is a rear perspective view of the scalp washing device 10, FIG. 13 is a front view of the scalp washing device 10, FIG. 14 is a plan view of the scalp washing device 10, FIG. 15 is a left side view of the scalp washing device 10, FIG. 16 is a right side view of the scalp washing device 10, FIG. 17 is a bottom surface view of the scalp washing device 10, and FIG. 18 is a cross-sectional view taken along the line XVIII-XVIII in FIG. 17.

As shown in FIGS. 1 to 3, the scalp washing brush 10 as a scalp washing device includes a brush surface 30*a* having a handle 22 of a base 1 that is provided with plural projections for washing (spatular projections in the present embodiment) 41 made of, for example, elastomer resin and having different shapes, and two types of plural conical projections (projections for scraping off skin oil and projections for massaging) 45 and 46. At the time of washing and taking care of hair, a user sandwiches a pillar portion 21 of the handle 22 between the fingers, and holds the scalp washing brush 10 touching an upper surface 20*a* of the base 11 opposite to the brush surface 30*a* and covering the upper surface 20*a* with the palm. Then, the user moves the scalp washing brush 10 to brush the hair while pressing the plural spatular projections 41 and the two types of plural conical projections 45 and 46 projected from the brush surface 30*a* against the scalp. Accordingly, a removal of skin oil and cleansing of pores can be performed effectively while an excellent massage effect is obtained in association with the action of a washing agent, a hair care agent or a cosmetic agent applied to the scalp and hair as necessary. In the present embodiment, the pillar portion 21 is eccentrically provided while having a thin wall body when viewed from the side and a wide surface extending from one end (left side in FIG. 1) to the middle of the upper surface 20*a* of the base 11 in a longitudinal direction when viewed from the front. Due to the pillar portion 21 having such a configuration, the user can easily hold the scalp washing brush 10 while sandwiching the pillar portion 21 between the fingers and touching the upper surface 20*a* of the base 11 and covering the upper surface 20*a* with the palm.

In the specification of the present invention, the projections for washing (the spatular projections in the present embodiment) 41 and the two types of conical projections (the projections for scraping off skin oil and the projections for massaging) 45 and 46 may be simply referred to as the projections.

As shown in FIGS. 2 and 3, the base 11 includes a base body 20 made of synthetic resin or the like having the handle 22, and a base plate 30 made of synthetic resin or the like attached to an attachment opening (opening) 25 formed on the bottom surface of the base body 20. A bottom board 40 made of elastomer resin is sandwiched between the base body 20 and the base plate 30, and provided with the spatular projections 41 and the two types of conical projections 45 and 46 that are integrally formed on and projected from the bottom board 40. In addition, the base plate 30 is provided with plural through-holes 31, 35 and 36 into which root portions 41*b*, 45*b* and 46*b* of the projections 41, 45 and 46 are inserted, so that the respective projections 41, 45 and 46 are projected out of the bottom surface (the brush surface) 30*a* of the base plate 30.

In the present embodiment, when the base plate 30 is attached to the attachment opening 25 formed on the bottom surface of the base body 20, the lower surface (the brush surface) 30*a* of the base plate 30 and the interface (circular in cross-section) between the root portion and the middle portion of the respective projections 41, 45 and 46 are on the same level. The respective through-holes 31, 35 and 36 formed on the brush surface 30*a* have a diameter with approximately 2 mm larger than that of the interface between the root portion and the middle portion of the respective projections 41, 45 and 46.

As shown in FIGS. 1 to 3 and FIG. 10, the base body 20 has the upper surface 20*a* having a smooth curved convex surface and the attachment opening 25 having an elliptic shape opened at the bottom surface, in which the long axis length of the elliptic planar shape is approximately 80 mm and the short axis length is approximately 60 mm.

The upper surface 20*a* of the base body 20 is provided with the handle 22 integrally formed into a shape of ears (a pair of curved wedges having an approximately T shape in cross-section) of an animal (for example, rabbit) via the pillar portion 21 and projected from one end (the left side in the figure) to the middle of the upper surface 20*a*. In addition, the upper surface 20*a* of the base body 20 is provided at the other end (the right side in the figure) with the tail portion 23 integrally formed into a tail shape (for example, a bowl shape, a hemisphere shape) of an animal (for example, rabbit) projected therefrom. In the present embodiment, in order to allow the scalp washing brush 10 to easily stand by itself on a table D (see FIG. 10(*b*)) while keeping the respective projections 41, 45 and 46 facing upward, it is preferable to provide a flat portion 22*a* at the rear end portion of the handle 22 and a flat portion 23*a* at the tail portion 23 of the base body 20. Due to the respective flat portions 22*a* and 23*a*, when making the scalp washing brush 10 stand by itself on the table D while keeping the respective projections 41, 45 and 46 projected from the brush surface 30*a* of the base body 20 facing upward as shown in FIG. 10(*b*), the flat portion 22*a* at the rear end portion of the handle 22 and the flat portion 23*a* at the tail portion 23 of the base body 20 can stably be in contact with and stand on the table D or the like.

As shown in FIG. 10(*a*), the height from the upper surface 20*a* of the base body 20 to the rear end portion of the handle 22 is set to a predetermined length (for example, 26.8 mm). In addition, the support portion 21 to support the handle 22 of the base body 20 is set to have a predetermined width (for example, 5 mm). Further, a rear end portion 21*a* of the support portion 21 is inclined at a predetermined angle θ (for example, θ=5°) to the tail portion 23 so that the base between the fingers does not excessively come close to the handle 22.

As shown in FIGS. 2 and 3, the attachment opening 25 of the base body 20 has a fixing concave groove 26 formed along the whole inner periphery thereof to be fixed and engaged with the bottom board 40 and the base plate 30 stacked on top of each other. The bottom board 40 is supported by a periphery indented portion 26*a* formed at the upper portion of the fixing concave groove 26 and a support piece 27 hanging from the under surface of the base body 20. On the other hand, the base plate 30 is fixed to a fixing rim 26*b* formed at the lower portion of the fixing concave groove 26. Thus, the bottom board 40, which is made of elastomer resin and provided with the spatular projections 41 and the two types of conical projections 45 and 46 that are integrally formed on and projected from the bottom board 40, is fixed by being interposed between the periphery indented portion 26*a* and the support piece 27 of the base body 20 and the base plate 30.

As shown in FIGS. 1 to 3, the base plate 30 is formed into the same elliptic shape as the attachment opening 25 of the base body 20. In addition, the base plate 30 is provided with a projected periphery surface 30*b* to be engaged with the fixing concave groove 26 of the base body 20 so that the base plate 30 is integrally fixed to the base body 20. The lower surface 30*a* of the base plate 30 is a bottom surface of the base 11 composing a brush surface. In the base plate 30, the through-holes 31, 35 and 36 having a circular shape are formed at the positions corresponding to the locations of the spatular projections 41 and the two types of conical projections 45 and 46 described below to allow the respective projections 41, 45 and 46 to pass through.

As shown in FIGS. 1 to 10, the spatular projections 41 and the two types of conical projections 45 and 46 are integrally formed on and projected from a bottom surface 40*a* of the bottom board 40 made of elastomer resin. As shown in FIGS. 4 to 7, the spatular projections 41 are formed into a circular shape in cross-section at the root portions 41*b* thereof. In addition, the respective spatular projections 41 are integrally formed in such a manner that the configuration from a side of the root portion 41*b* to a side of a middle portion 41*a* (a tip surface 41*c*) changes from a circular shape in cross-section to an elliptic shape in cross-section (a flattened shape in cross-section). In the present embodiment, the configuration from the boundary of the root portion 41*b* and the middle portion 41*a* (the portion taken along the line VIIb-VIIb in FIG. 6) to the tip surface 41*c* of the middle portion 41*a* changes from a circular shape in cross-section to an elliptic shape in cross-section. Note that, an elliptic shape used in the specification of the present invention includes an oval shape consisting of a straight line and a curved line (a shape of a track for athletic sports) in addition to a common elliptic shape consisting only of a curved line. For example, FIG. 7(*c*) shows an oval shape. The tip surface 41*c* of the middle portion 41*a* having an elliptic shape in cross-section is provided with a pair of tip projections 42 and 42 having approximately a conical shape formed in such a manner that each tip 42*a* is chamfered to have a curved surface. As shown in FIG. 4, the spatular projections 41 are integrally formed on and projected from the bottom surface 40*a* of the bottom board 40 in such a manner that the spatular projections 41 are arranged in plural and parallel rows (for example, in three rows of three projections, seven projections and three projections, each projection being aligned at predetermined intervals) from the center of the brush surface 30*a* toward the right and left sides thereof (at the top and bottom sides in FIG. 4) (toward the periphery of the base 11) in a longitudinal direction of the bottom surface 40*a* of the bottom board 40 (the brush surface 30*a* of the base 11). In addition, as shown in FIGS. 3 and 5, the height of each tip 42*a* of the tip projections 42 of the respective spatular projections 41 located at the outer side is higher (for example, 21 mm from the brush surface 30*a*) than that of each tip 42*a* of the tip projections 42 of the respective spatular projections 41 located at the inner side (for example, 17 mm from the brush surface 30*a*) in each row. The diameter of the root portion 41*b* of the respective spatular projections 41 shown in FIG. 7(*a*) is adjusted to, for example, 7.2 mm, and the diameter of the root portion 41*b* shown in FIG. 7(*b*) is adjusted to, for example, 6.5 mm.

As shown in FIGS. 4 and 5, the plural conical projections for scraping off skin oil 45 and the plural conical projections for massaging 46 are alternately arranged between the respective rows of the plural spatular projections 41. As shown in FIG. 8, the conical projection for scraping off skin oil 45 has approximately a conical shape formed in such a manner that a tip 45*a* is chamfered to have a curved surface. As shown in FIG. 9, the conical projection for massaging 46 has approximately a conical shape formed in such a manner that a tip 46*a* is chamfered to have a curved surface. The curved surface of the respective tips 45*a* of the conical projections for scraping off skin oil 45 has the same small diameter (for example, 0.6 mm in radius) as the curved surface of the respective tips 42*a* of the tip projections 42 of the spatular projections 41. The curved surface of the respective tips 46*a* of the conical projections for massaging 46 has a larger diameter (for example, 1.2 mm in radius) than the curved surface of the tips 45*a* of the conical projections for scraping off skin oil 45. Further, as shown in FIG. 4, each tip 45*a* of the respective conical projections for scraping off skin oil 45 and each tip 46*a* of the respective conical projections for massaging 46 are aligned in approximately the same line as each tip 42*a* of the tip portions of the respective spatular projections in a long axis direction X of the middle portions 41*a* having an elliptic shape in cross-section of the spatular projections 41.

The root portion 41*b* of the respective spatular projections 41 is formed to have the same diameter as that of the root portion 45*b* of the respective conical projections for scraping off skin oil 45 and the root portion 46*b* of the respective conical projections for massaging 46. In the present embodiment, the bottom board 40 and the respective projections 41, 45 and 46 are a resin molded article integrally formed and made of elastomer resin. The "elastomer resin" is a general term for resin having rubber-like elasticity. Examples of the elastomer resin include olefinic elastomer, styrene elastomer, polyester elastomer, urethane elastomer, and acrylic elastomer. In the present embodiment, styrene elastomer is used. The styrene elastomer has good transparency. When the scalp washing brush 10 is commercialized, the appearance of the scalp washing brush 10 made of the styrene elastomer is improved, and good cleansing performance and massaging performance for scalp can also be achieved. In order to determine the figure, dimension, and the like of the respective projections 41, 45 and 46, prototypes of the scalp washing brush 10 may be made by use of an RP (rapid prototyping) apparatus using three-dimensional CAD data to evaluate a cleansing effect and massaging effect. The RP apparatus is an apparatus employing a photofabrication technology, and is capable of making prototypes in a short period of time if three-dimensional CAD data is used without a metal mold. In such a case, acrylic elastomer for the RP apparatus may be used. The elastomer includes rubber-like resin, and can be effectively used for the performance evaluation of the prototypes of the scalp washing brush 10 of the present invention.

As described above, according to the scalp washing brush 10 of the first embodiment, the root portion 41*b* of the respective spatular projections 41 is formed into a circular shape in cross-section, and the configuration from a side of the root portion 41*b* to a side of the middle portion 41*a* (the tip surface 41*c*) changes from a circular shape in cross-section to an elliptic shape in cross-section. In addition, the tip surface 41*c* of the middle portion 41*a* having an elliptic shape in cross-section is provided with the pair of tip projections 42 and 42 having a conical shape formed in such a manner that the tip 42*a* is chamfered to have a curved surface. Therefore, since the root portions 41*b* of the spatular projections 41 are hard to be deformed so as not to easily bend, the pair of tip projections 42 and 42 of the spatular projections 41 surely come into contact with skin and pores of the scalp even when hair becomes an obstacle at the time of washing. Accordingly, the pair of tip projections 42 and 42 are deformed to reliably remove skin oil excreted from the pores by the respective tips 42*a* and surely cleanse the pores and skin.

The spatular projections 41 are arranged in plural and parallel rows and aligned at predetermined intervals in each row at the center and at the both sides (toward the periphery) of the brush surface 30*a* of the base 11. In addition, the tips 42*a* are arranged in a circular arc line in each row in such a manner that the height of the pair of tip projections 42 and 42 of the respective spatular projections 41 located at the outer side is higher than that of the pair of tip projections 42 and 42 of the respective spatular projections 41 located at the inner side in each row. Therefore, all the tips 42*a* of the pairs of tip projections 42 and 42 of the spatular projections 41 can surely and easily be pressed against the curved skin of the scalp to remove skin oil and cleanse pores effectively.

In addition, the plural conical projections for scraping off oil skin 45 and the plural conical projections for massaging 46 are alternately arranged between the respective rows of the plural spatular projections 41. Therefore, the removal of skin oil and cleansing of pores can be performed efficiently, and at the same time, the scalp can also be massaged effectively.

The base 11 includes the base body 20 made of synthetic resin and having the handle 22, and the base plate 30 made of synthetic resin and attached to the attachment opening 25 formed on the bottom surface of the base body 20. The respective projections 41, 45 and 46 are integrally formed on and projected from the bottom board 40 made of elastomer resin and sandwiched between the base body 20 and the base plate 30. The base plate 30 is provided with the plural through-holes 31, 35 and 36 into which the root portions 41*b*, 45*b* and 46*b* of the respective projections 41, 45 and 46 are inserted, and the respective projections 41, 45 and 46 are projected out of the bottom surface 30*a* of the base plate 30. Accordingly, since the number of the parts composing the scalp washing device 10 can be reduced to the minimum, the whole structure can be simplified and a reduction in cost can be achieved. Moreover, since the above-described configuration can prevent water or dust from entering the attachment opening 25, the scalp washing device 10 can be kept clean.

Further, the base body 20 has the upper surface 20*a* having a curved convex surface, and the upper surface 20*a* is provided with the handle 22 integrally formed into a shape of right and left ears of an animal and projected from one end to the middle of the upper surface 20*a* via the plate-like pillar portion 21. In addition, the upper surface 20*a* of the base body 20 is provided with the tail portion 23 integrally formed into a tail shape of an animal projected from the other end of the upper surface 20*a*. The tail portion 23 and the rear end portion of the handle 22 having an ear shape are provided with the flat portions 23*a* and 22*a*, respectively. Accordingly, an aesthetic appearance of the base body 20 is improved. In addition, since the flat portions 22*a* and 23*a* function as a support member, the base 11 can stand by itself on the table D or the like while the respective projections 41, 45 and 46 face upward (see FIG. 10(*b*). Thus, due to the flat portions (the support members) 22*a* and 23*a* provided on the upper surface 20*a* of the base body 20, the brush surface 30*a* can be kept facing upward, so that deformation and damage of the tips 42*a*, 45*a* and 46*a* of the respective projections 41, 45 and 46 are prevented.

Figure 19:
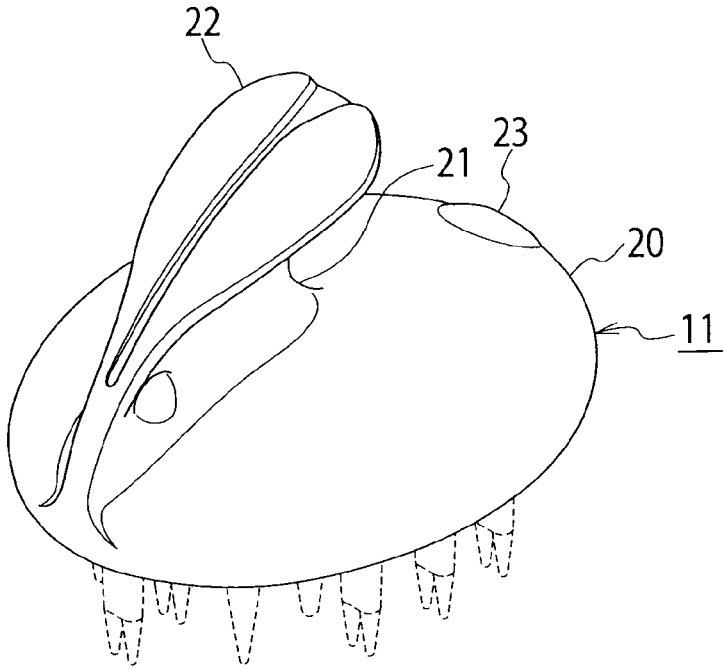
FIG. 19 is a front perspective view of a base having the handle of the scalp washing device.
Figure 20:
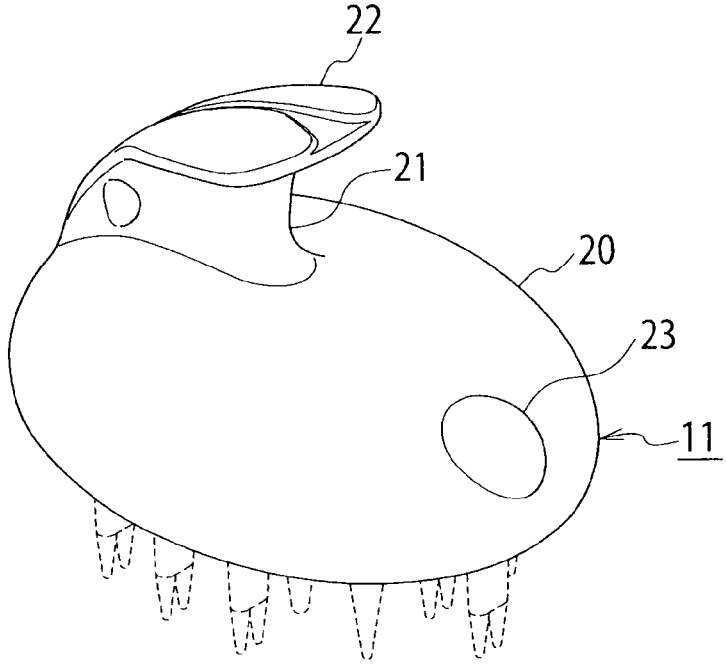
FIG. 20 is a rear perspective view of the base.
Figure 21:
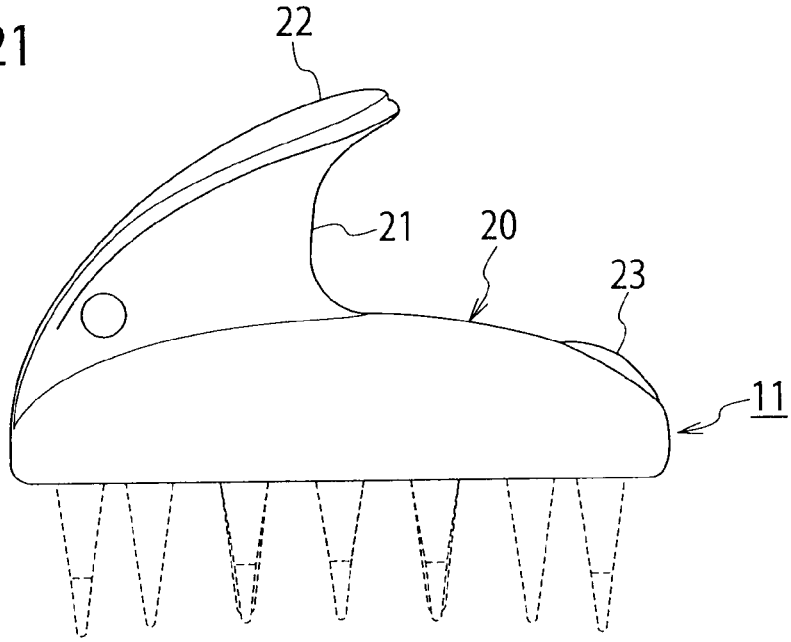
FIG. 21 is a front view of the base.
Figure 22:
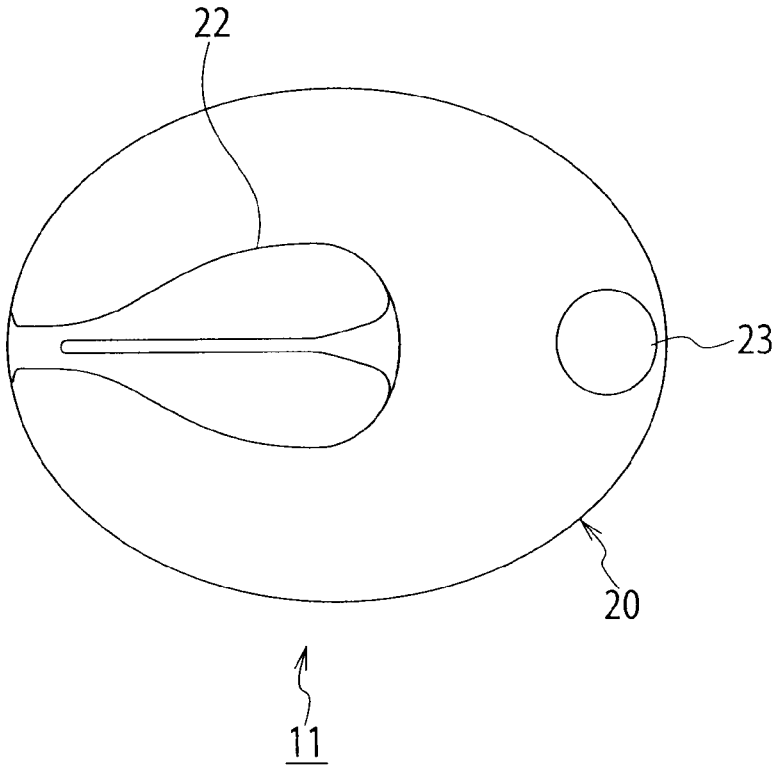
FIG. 22 is a plan view of the base.
Figure 23:
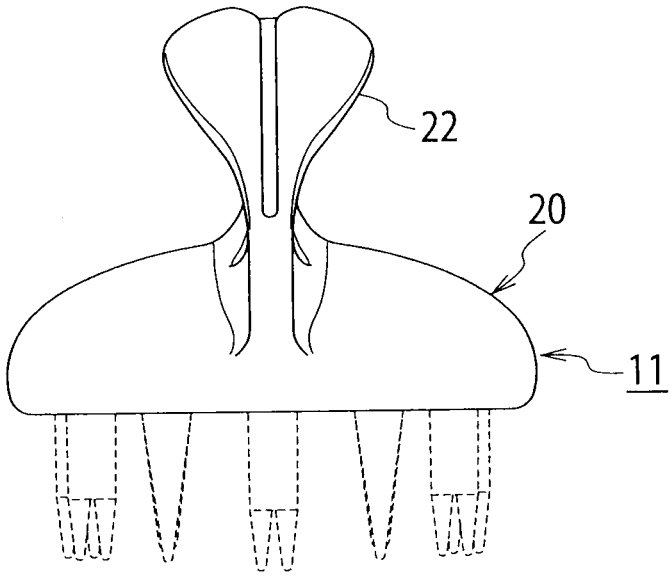
FIG. 23 is a left side view of the base.
Figure 24:
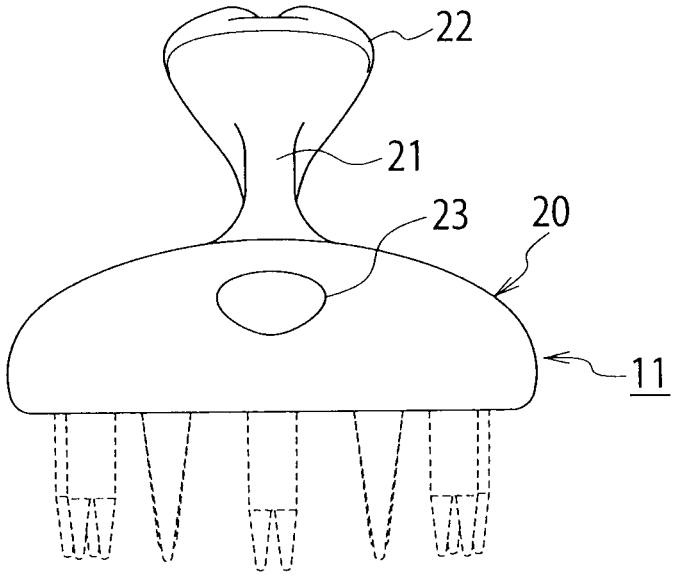
FIG. 24 is a right side view of the base.
Figure 25:
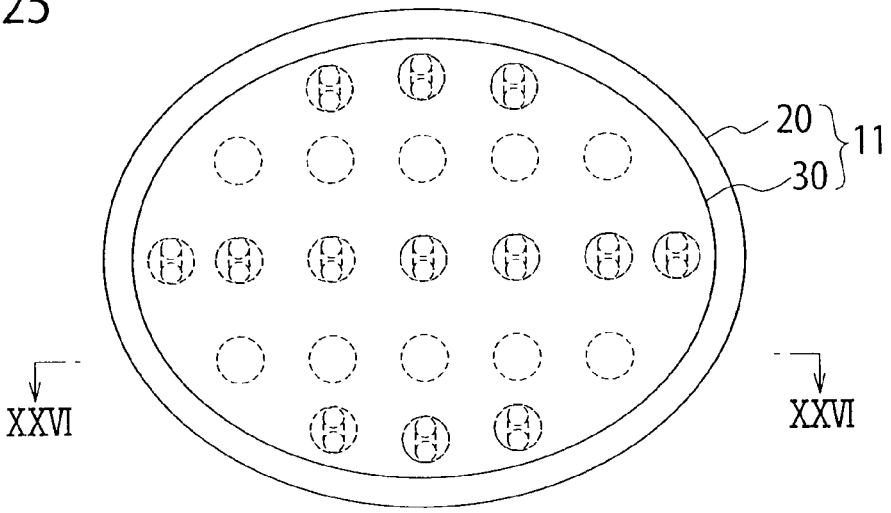
FIG. 25 is a bottom surface view of the base.
Figure 26:
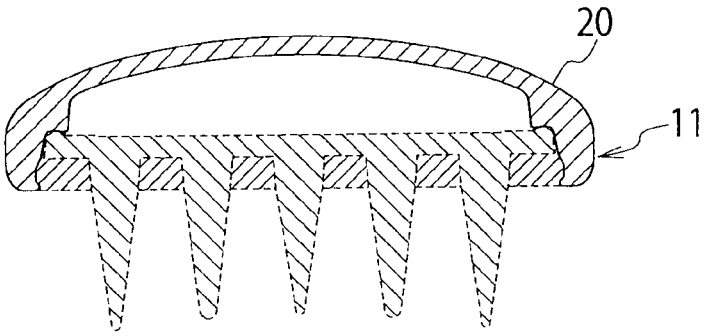
FIG. 26 is a cross-sectional view taken along the line XXVI-XXVI in FIG. 25.

FIG. 19 is a front perspective view of the base having the handle of the scalp washing brush as a scalp washing device, FIG. 20 is a rear perspective view of the base, FIG. 21 is a front view of the base, FIG. 22 is a plan view of the base, FIG. 23 is a left side view of the base, FIG. 24 is a right side view of the base, FIG. 25 is a bottom surface view of the base, and FIG. 26 is a cross-sectional view taken along the line XXVI-XXVI in FIG. 25. The portions indicated by the solid lines are to be applied for design registration by part design.

The base body 20 has the upper surface 20*a* having a curved convex surface, and the upper surface 20*a* is provided with the handle 22 integrally formed into a shape of right and left ears of a rabbit and projected from one end to the middle of the upper surface 20*a* via the pillar portion 21. In addition, the upper surface 20*a* of the base body 20 is provided with the tail portion 23 integrally formed into a tail shape of a rabbit projected from the other end of the upper surface 20*a*. The rear end portion of the handle 22 having an ear shape of a rabbit and the tail portion 23 having a tail shape of a rabbit are provided with the flat portions 22*a* and 23*a*, respectively. Accordingly, an aesthetic appearance of the base body 20 is improved. In addition, since the base 11 can stand by itself on the table D or the like while the respective projections 41, 45 and 46 face upward, the usability of the scalp washing brush is greatly improved. Thus, since the scalp washing brush 10 of the present invention can be kept on the table D or the like while the respective projections 41, 45 and 46 are kept facing upward, deformation of the respective projections during the unused state is prevented. Moreover, the scalp washing brush can be easily dried after the respective projections are washed with water.

Second Embodiment

Figure 27:
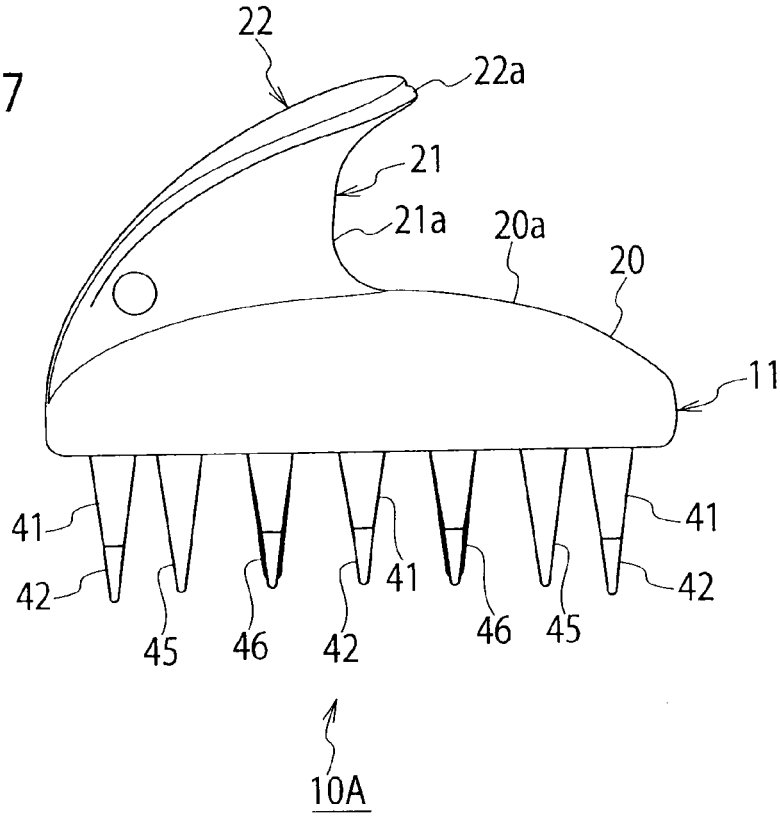
FIG. 27 is a front view showing a scalp washing device according to a second embodiment of the present invention.
Figure 28:
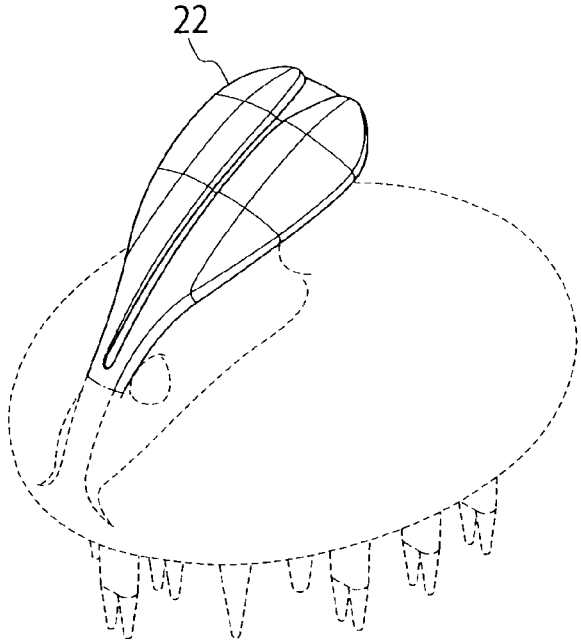
FIG. 28 is a front perspective view of a handle of the scalp washing device according to the second embodiment.
Figure 29:
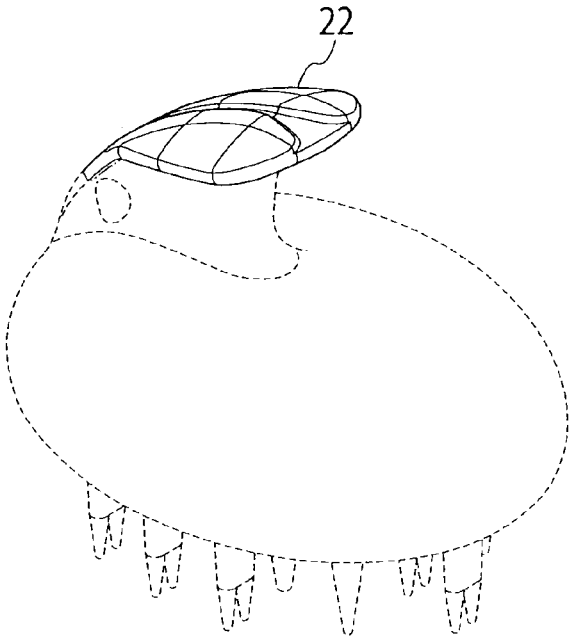
FIG. 29 is a rear perspective view of the handle of the scalp washing device according to the second embodiment.
Figure 30:
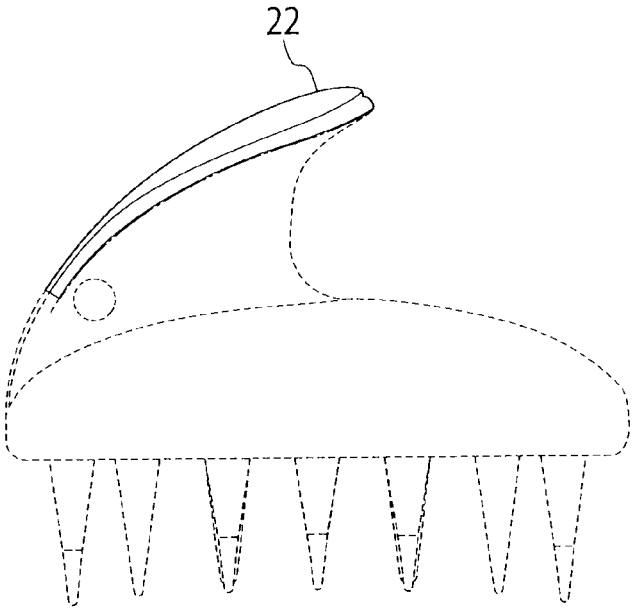
FIG. 30 is a front view of the handle of the scalp washing device according to the second embodiment of the present invention.
Figure 31:
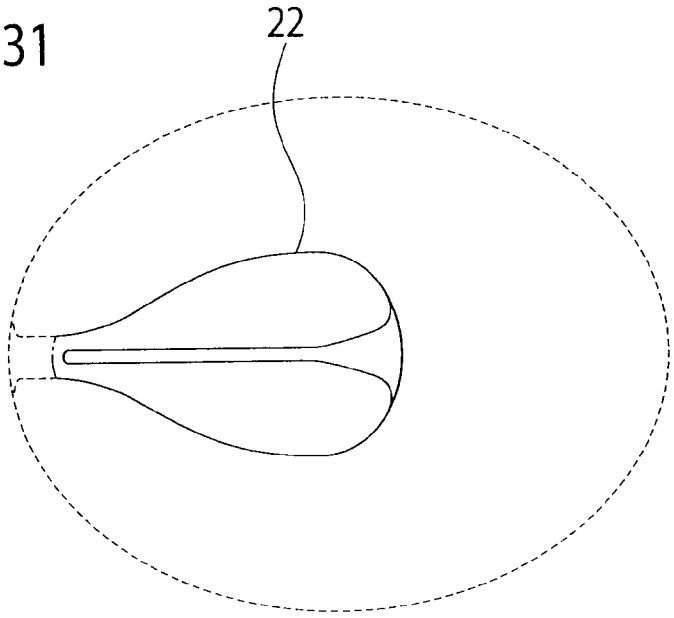
FIG. 31 is a plan view of the handle of the scalp washing device according to the second embodiment of the present invention.
Figure 32:
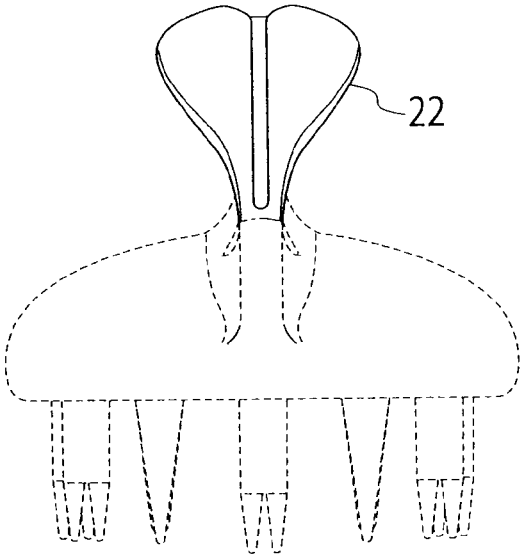
FIG. 32 is a left side view of the handle of the scalp washing device according to the second embodiment of the present invention.
Figure 33:
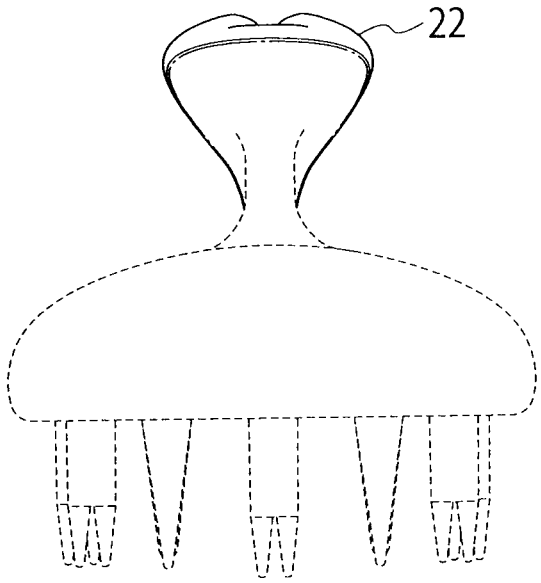
FIG. 33 is a right side view of the handle of the scalp washing device according to the second embodiment of the present invention.
Figure 34:
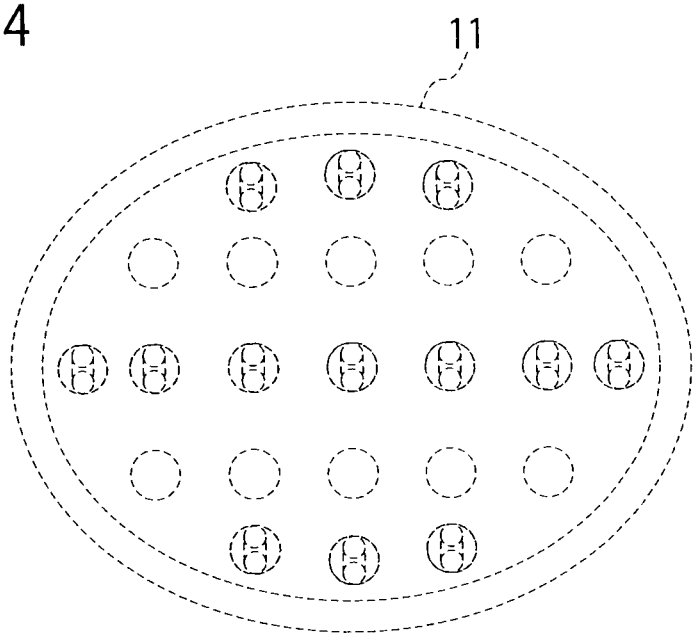
FIG. 34 is a bottom surface view of the handle of the scalp washing device according to the second embodiment of the present invention.

FIG. 27 is a front view showing a scalp washing brush 10A as a scalp washing device according to a second embodiment of the present invention, FIG. 28 is a front perspective view of the handle 22 of the scalp washing brush 10A, FIG. 29 is a rear perspective view of the handle 22, FIG. 30 is a front view of the handle 22, FIG. 31 is a plan view of the handle 22, FIG. 32 is a left side view of the handle 22, FIG. 33 is a right side view of the handle 22, and FIG. 34 is a bottom surface view of the handle 22. The portions indicated by the solid lines are to be applied for design registration by part design. The dashed lines indicate only the boundaries between the portions to be applied for design registration by part design and the other portions. In FIGS. 28 and 29, the grid thin lines shown on the surface indicate the configuration of the three-dimensional surface.

In the scalp washing brush 10A as a scalp washing device of the second embodiment, the base body 20 has the upper surface 20*a* provided with the handle 22 integrally formed into a shape of right and left ears of a rabbit and projected from one end to the middle of the upper surface 20*a* via the pillar portion 21. However, the upper surface 20*a* of the base body 20 is not provided with the tail portion 23 integrally formed into a tail shape of a rabbit projected from the other end of the upper surface 20*a*.

Since the handle 22 is formed into a shape of right and left ears of a rabbit, an aesthetic appearance is improved, and a user can hold the handle 22 quite easily.

The present invention is not limited to the above-described embodiments, and various modifications and improvements can be possible.

For example, the handle 22 is formed into a shape of ears of an animal such as a rabbit in the first and second embodiments. However, the handle 22 is not limited to the shape of ears of an animal, and may be formed into an eave shape extending horizontally to support the fingers holding the pillar portion 21 therebetween. The shape of ears of an animal is one of the eave shapes. In the specification of the present invention, the eave shape is a shape having a flared portion extending from the pillar portion 21 in a horizontal direction (in a thickness direction of the pillar portion) as viewed from the side. The tail portion 23 formed at the other end of the upper surface 20*a* of the base body 20 is not limited to a tail shape of an animal, and may be a projection 23 having a convex shape (for example, approximately a hemisphere shape). The tail shape of an animal is one of the convex shapes. In the above-described embodiments, the flat portion 23*a* is formed on the tail portion 23 (the projection 23). However, a flat portion may be formed directly on the other end of the upper surface 20*a* of the base body 20. Further, in the embodiments, the rear end portion of the handle and the tail portion 23 (the projection 23) are provided with one flat portion, respectively. However, plural flat portions may be provided on each portion. The flat portions are formed in order that the base 11 can stand by itself on the table D or the like while the projections are kept facing upward. However, the projections are not limited to the projections 41, 45 and 46 in the above-described embodiments, and may be formed into any other shape. In addition, although the respective spatular projections 41 are provided with the pair of tip projections 42 and 42 at the tips thereof, more than two tip projections may be provided on the spatular projections 41. Moreover, the base plate 30 and the attachment opening 25 of the base body 20 are not limited to an elliptic shape, and may be any other circular shape. The diameter of the root portion 41*b* of the respective spatular projections 41 shown in FIG. 7(*a*) may be the same as the diameter of the root portion 41*b* shown in FIG. 7(*b*).

The components not explained in one embodiment and requirements included only in one embodiment may be applied to the other embodiment, respectively. In addition, the requirements in each embodiment may be replaceable mutually between the embodiments as necessary.

Hereinafter, the present invention will be explained in more detail with reference to examples.

Example 1

Hair washing was actually carried out by using the scalp washing brush with the following specification under the following conditions to evaluate the scalp washing brush by a sensory evaluation.

<Specification of Scalp Washing Brush>

1. Bottom Board

Figure 35:
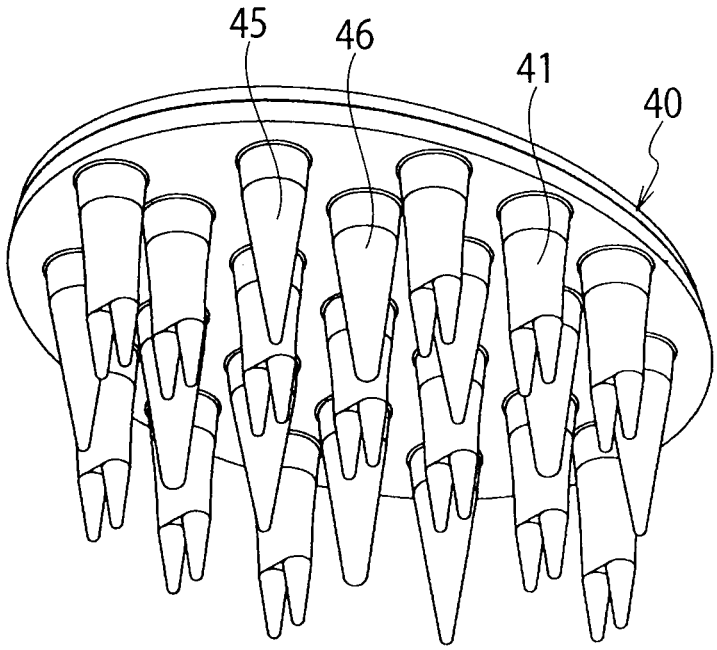
FIG. 35 is a perspective view of a bottom board of Example 1.
Figure 36:
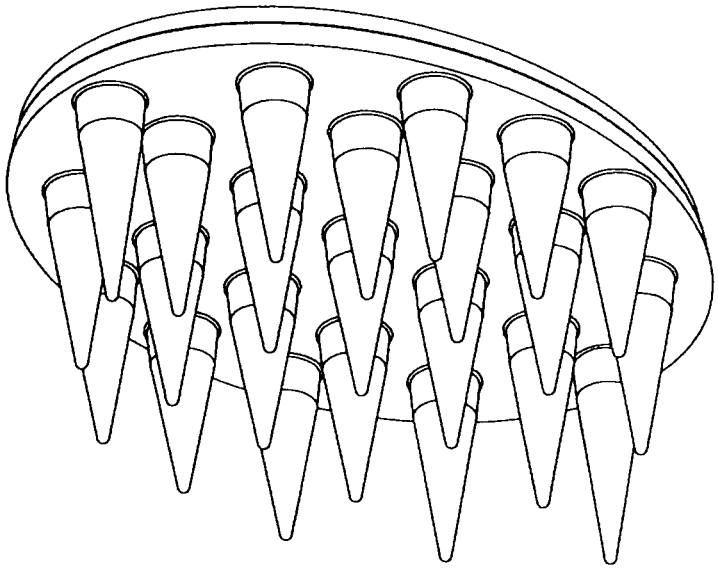
FIG. 36 is a perspective view of a bottom board of Comparative Example 1.
Figure 37:
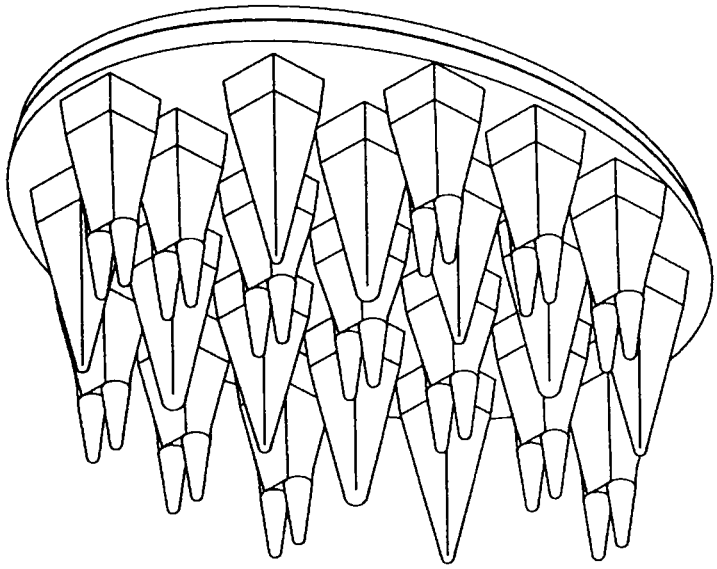
FIG. 37 is a perspective view of a bottom board of Comparative Example 2.
Figure 38:
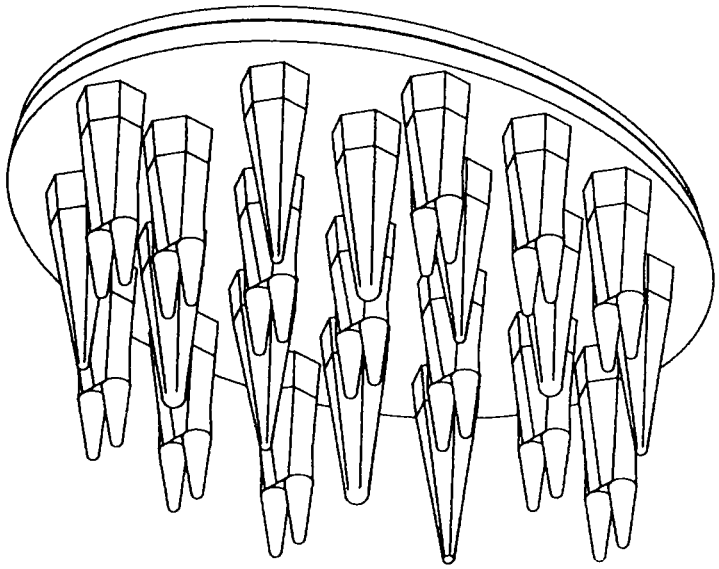
FIG. 38 is a perspective view of a bottom board of Comparative Example 3.

The bottom board shown in FIG. 35 was used. FIG. 35 is a perspective view of the bottom board 40. The bottom board 40 has the largest long diameter of 80.8 mm, and the largest short diameter of 60.8 mm. Comparative Example 1, Comparative Example 2 and Comparative Example 3 are shown in FIG. 36, FIG. 37 and FIG. 38, respectively.

The bottom board 40 was manufactured by use of an RP (rapid prototyping) apparatus (EDEN 350V) of Objet Geometries Ltd. (Israel). The bottom board 40 was made of acrylic elastomer (Tango Gray Full Cure 950, a Shore scleroscope hardness rate is 75% (a catalog value) on the evaluation basis of ASTM D-2240). The spatular projections 41 and the two types of conical projections 45 and 46 were integrally formed on and projected from the bottom board 40 and made of the same material as the bottom board 40.

2. Spatular Projections (Projections for Washing)

Figure 39:
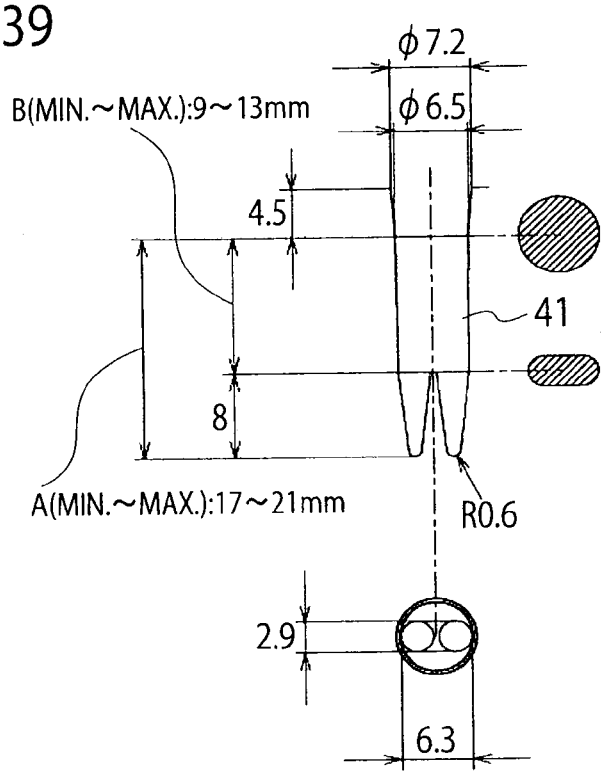
FIG. 39 shows a side view, a plan view and a cross-sectional view of a spatular projection (projection for washing) of Example 1.
Figure 49:
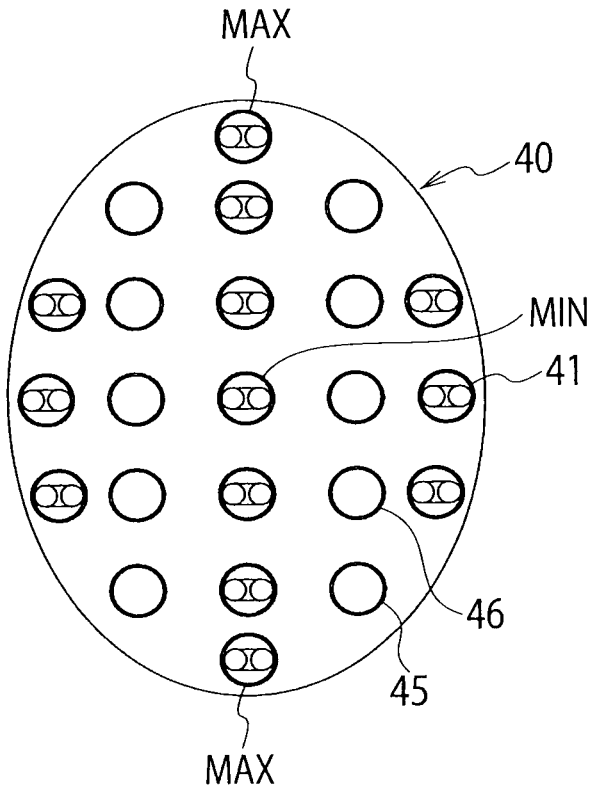
FIG. 49 is a plan view of the bottom board of Example 1.

The projection shown in FIG. 39 was used. FIG. 39 is a side view, a plan view and a cross-sectional view of the spatular projection 41 projected from the bottom board 40. The root portion of this projection (height of 4.5 mm) is formed into a circular shape in cross-section. The configuration from a side of the root portion to a side of the middle portion changes from a circular shape in cross-section to a flattened shape (an oval shape) in cross-section. In this example, the height A of each tip of the tip projections of the respective spatular projections 41 located at the outer side is higher (21 mm from the brush surface) than the height A of each tip of the tip projections of the respective spatular projections 41 located at the inner side (17 mm from the brush surface) in each row in the same manner as FIGS. 3 and 5. FIG. 49 is a plan view of the bottom board 40 of Example 1, and shows the arrangement of the heights A of the lowest projection (MIN in FIG. 49) and the highest projections (MAX in FIG. 49) of the tips of the tip projections of the spatular projections 41 in each row. The heights A of the tips of the tip projections of the other spatular projections 41 employ arbitrary values intermediate between the MIN value (17 mm from the brush surface) and the MAX value (21 mm from the brush surface) so that the respective tips are arranged in a circular arc line.

3. Conical Projections (Projections for Scraping Off Skin Oil)

Figure 43:
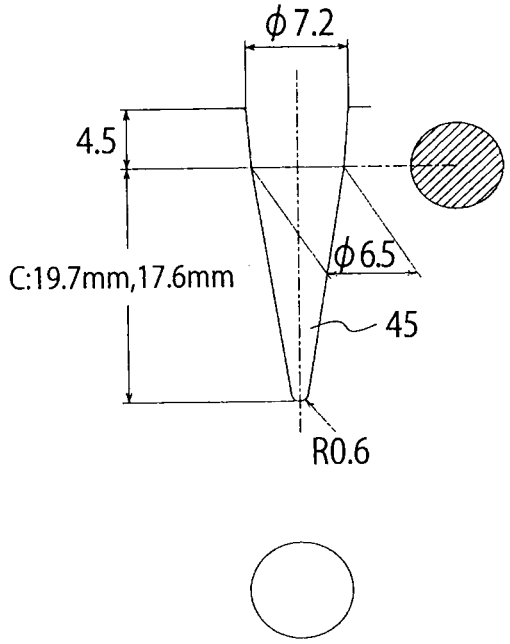
FIG. 43 shows a side view, a plan view and a cross-sectional view of a conical projection (projection for scraping off skin oil) of Example 1 and Comparative Example 1.
Figure 50:
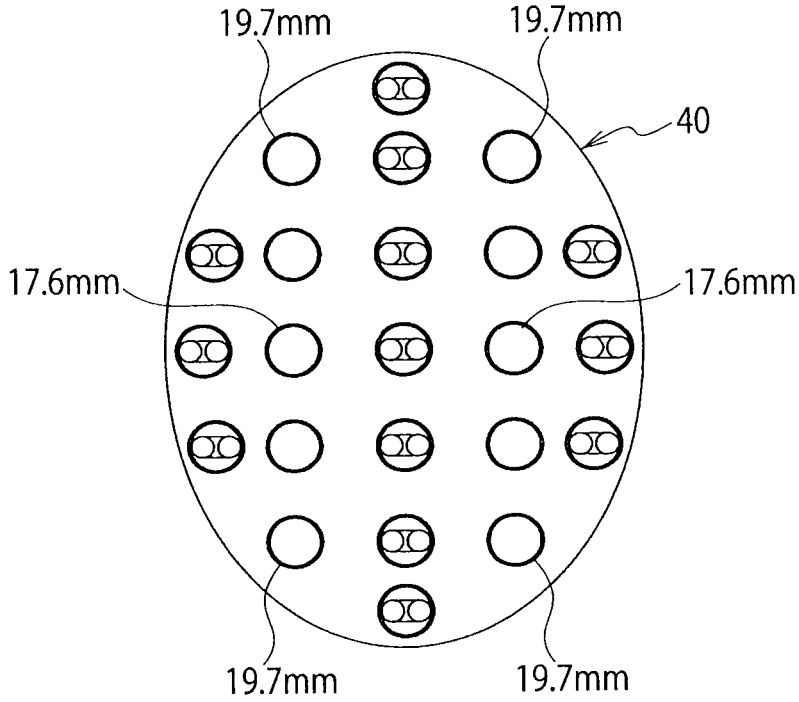
FIG. 50 is a plan view of the bottom board showing the arrangement of two types of conical projections (projection for scraping off skin oil) having different heights used in Example 1.

The conical projection shown in FIG. 43 was used. FIG. 43 is a front view, a plan view and a cross-sectional view of the projection for scraping off skin oil 45. The two types of projections having different heights C, 19.7 mm and 17.6 mm, from the brush surface to the tip of each projection were used. FIG. 50 is a plan view of the bottom board 40, and shows the arrangement of the two types of projections having different heights.

4. Conical Projections (Projections for Massaging)

Figure 44:
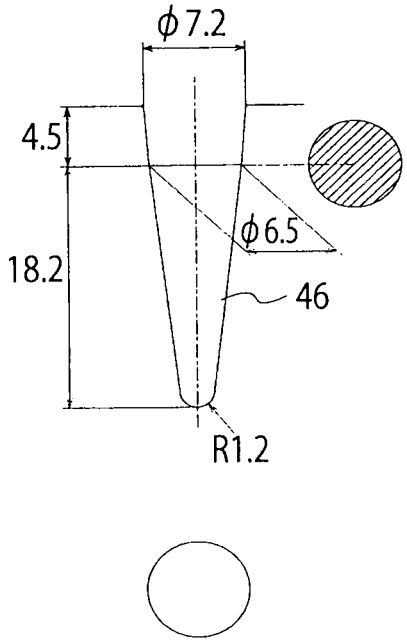
FIG. 44 shows a side view, a plan view and a cross-sectional view of a conical projection (projection for massaging) of Example 1 and Comparative Example 1.
Figure 51:
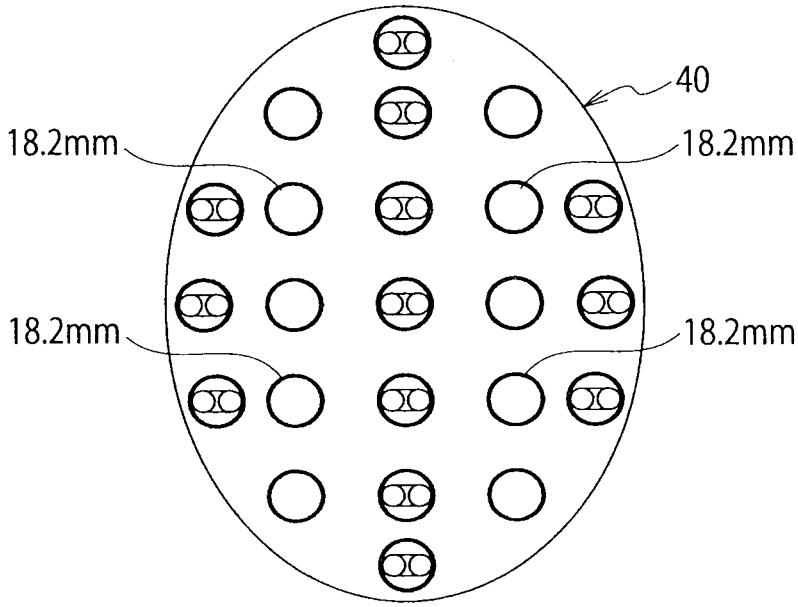
FIG. 51 is a plan view of the bottom board showing the arrangement of the conical projections (projection for massaging) used in Example 1.

The conical projection shown in FIG. 44 was used. FIG. 44 is a front view, a plan view and a cross-sectional view of the projection for massaging 46. The projections having the height of 18.2 mm from the brush surface to the tip of each projection were used. FIG. 51 is a plan view of the bottom board 40, and shows the arrangement of the projections.

<Evaluators>

5 women in 30s

<Used Shampoo>

Kao Corporation: ASIENCE Inner Rich Shampoo

<Method for Washing Hair>

1. Wet the entire hair well with warm water.

2. Apply an appropriate amount of the shampoo to the hair and move fingers to make bubbles sufficiently.

3. Bring the brush into contact with the scalp, and move the brush finely from side to side to wash the entire scalp.

4. Rinse off the shampoo completely with hot water.

<Evaluation Method>

Evaluation 1: Ease in Using the Scalp Washing Brush

The evaluation was carried out on a scale of one to ten, defining the highest point as "10 points: easy to move", and the lowest point as "1 point: hard to move".

Evaluation 2: Level of Projections Reaching Scalp

The evaluation was carried out on a scale of one to ten, defining the highest point as "10 points: feeling that the projections sufficiently reach the scalp", and the lowest point as "1 point: feeling that the projections hardly reach the scalp".

Evaluation 3: Washability

The evaluation was carried out on a scale of one to ten, defining the highest point as "10 points: feeling able to cleanse even pores sufficiently", and the lowest point as "1 point: feeling not able to cleanse at all".

Evaluation 4: Massage Performance

The evaluation was carried out on a scale of one to ten, defining the highest point as "10 points: feeling that blood circulation is improved", and the lowest point as "1 point: feeling no effect of massage".

Evaluation 5: Feeling During Washing Scalp

The evaluation was carried out on a scale of one to ten, defining the highest point as "10 points: comfortable and favorable", and the lowest point as "1 point: uncomfortable with a feeling of pain or stiffness because of the projections".

Evaluation 6: Tangle of Hair

The evaluation was carried out on a scale of one to ten, defining the highest point as "10 points: no tangle of hair", and the lowest point as "1 point: too tangled to wash hair".

<Evaluation Result>

As shown in FIG. 61, the average evaluation of the scalp washing brush 10 used in Example 1 was 9.1 points (on a scale of one to ten).

Comparative Example 1

Figure 40:
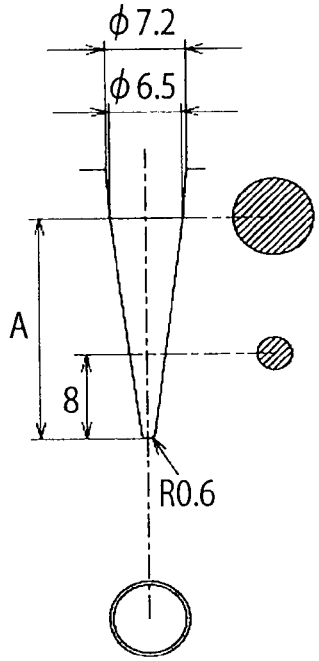
FIG. 40 shows a side view, a plan view and a cross-sectional view of a projection for washing of Comparative Example 1 corresponding to the projection for washing of Example 1.

The same scalp washing brush as Example 1 was used except for the bottom board in FIG. 36 and the projection for washing in FIG. 40, and the evaluation thereof was carried out. The material of the bottom board, the largest long diameter and the largest short diameter in this example are the same as Example 1.

Figure 52:
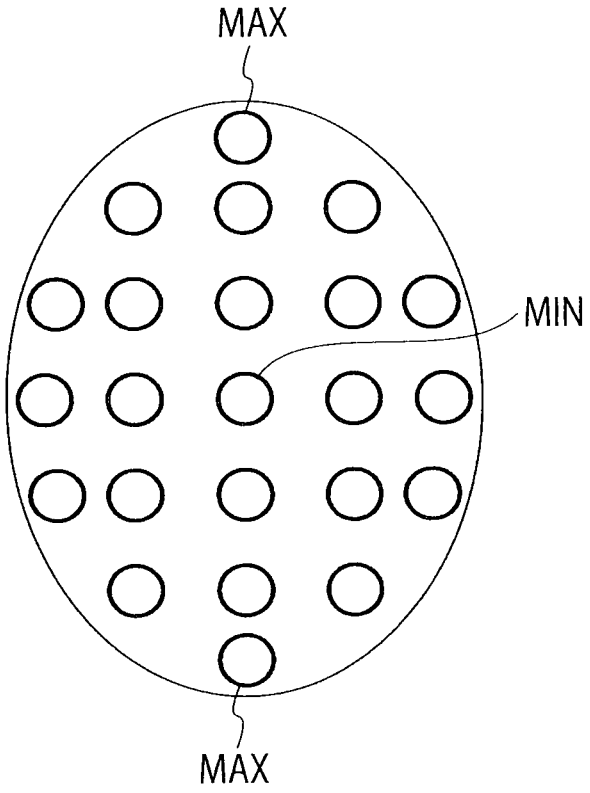
FIG. 52 is a plan view of the bottom board of Comparative Example 1.
Figure 53:
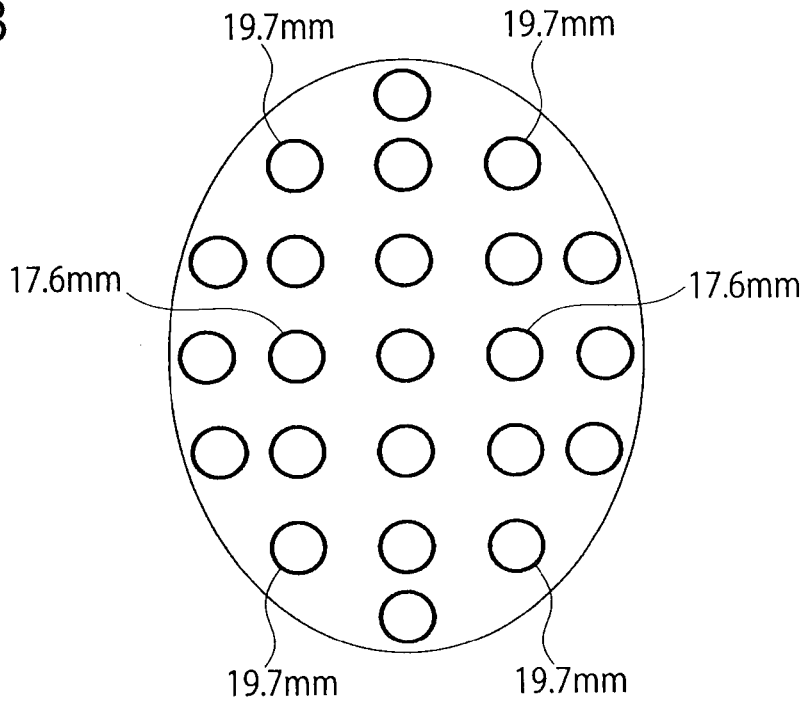
FIG. 53 is a plan view of the bottom board showing the arrangement of two types of conical projections (projection for scraping off skin oil) having different heights used in Comparative Example 1.
Figure 54:
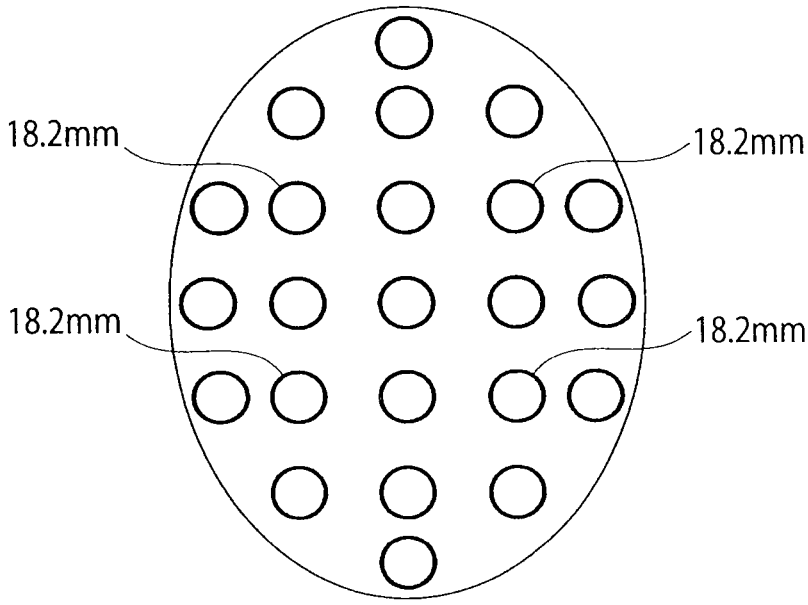
FIG. 54 is a plan view of the bottom board showing the arrangement of the conical projections (projection for massaging) used in Comparative Example 1.

The projection for washing shown in FIG. 40 was used. The root portion of this projection (height of 4.5 mm) is formed into a circular shape in cross-section. The section between the root portion and the middle portion and the section between the middle portion and the tip portion are formed into a circular shape in cross-section, respectively. Therefore, the projection from the boundary between the root portion and the middle portion to the tip is formed into a conical shape. In this comparative example, the height of each tip of the respective projections for washing located at the outer side is higher (21 mm from the brush surface) than the height of each tip of the respective projections for washing located at the inner side (17 mm from the brush surface) in each row in the same manner as Example 1. The arrangement of the lowest projection MIN and the highest projections MAX in each row is the same as Example 1 (refer to FIG. 52). The heights A of the tips the other projections for washing arbitrarily employ arbitrary values intermediate between the MIN value (17 mm from the brush surface) and the MAX value (21 mm from the brush surface) so that the respective tips are arranged in a circular arc line. The projections for scraping off skin oil and the projections for massaging in this example are the same as those in Example 1 (refer to FIGS. 43 and 44), and the arrangement of the respective projections is also the same as Example 1 (refer to FIGS. 53 and 54).

<Evaluation Result>

As shown in FIG. 61, the average evaluation of the scalp washing brush used in Comparative Example 1 was 6.9 points (on a scale of one to ten).

Comparative Example 2

Figure 41:
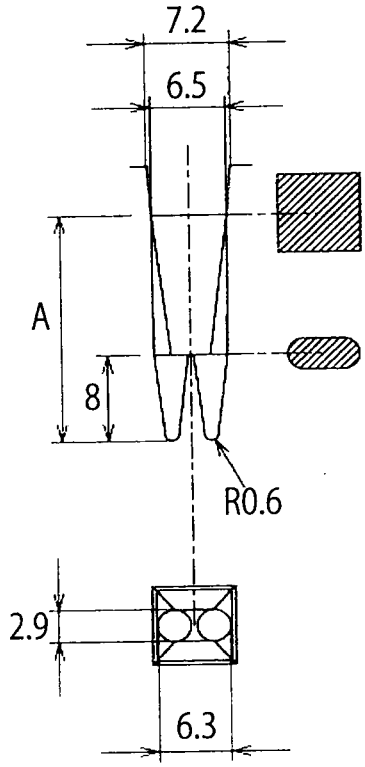
FIG. 41 shows a side view, a plan view and a cross-sectional view of a projection for washing of Comparative Example 2 corresponding to the projection for washing of Example 1.
Figure 45:
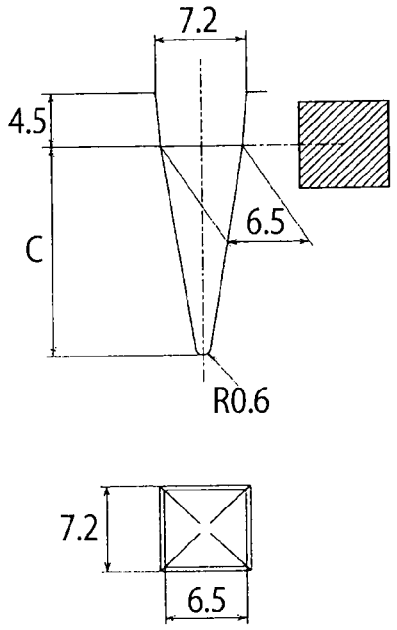
FIG. 45 shows a side view, a plan view and a cross-sectional view of a projection of Comparative Example 2 corresponding to the projection for scraping off skin oil of Example 1.
Figure 46:
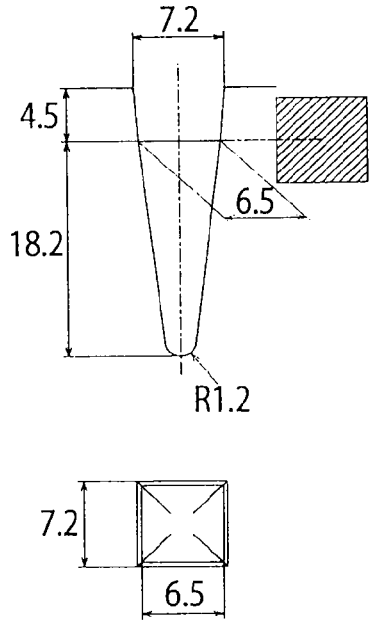
FIG. 46 shows a side view, a plan view and a cross-sectional view of the projection of Comparative Example 2 corresponding to the projection for massaging of Example 1.

The same scalp washing brush as Example 1 was used except for the bottom board in FIG. 37, the projection for washing in FIG. 41, the projection for scraping off skin oil in FIG. 45 and the projection for massaging in FIG. 46, and the evaluation thereof was carried out. The material of the bottom board, the largest long diameter and the longest short diameter in this example are the same as Example 1.

Figure 55:
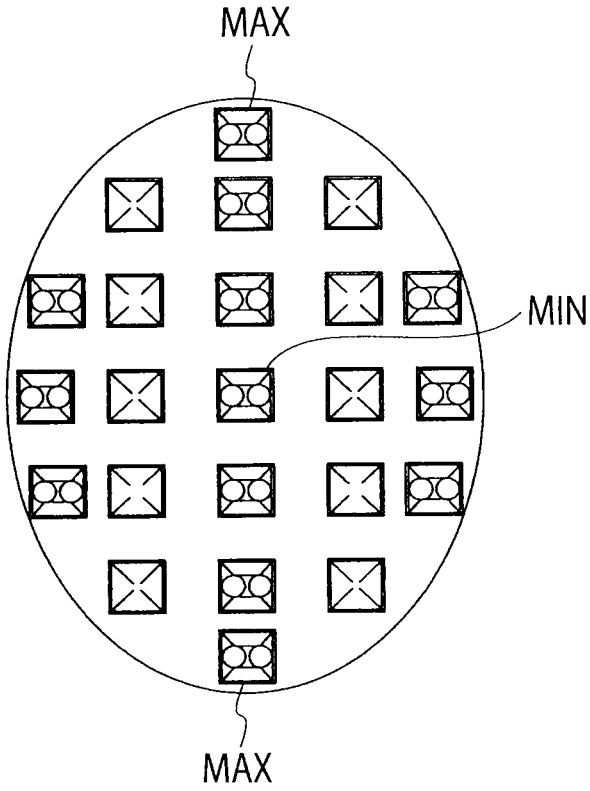
FIG. 55 is a plan view of the bottom board of Comparative Example 2.
Figure 56:
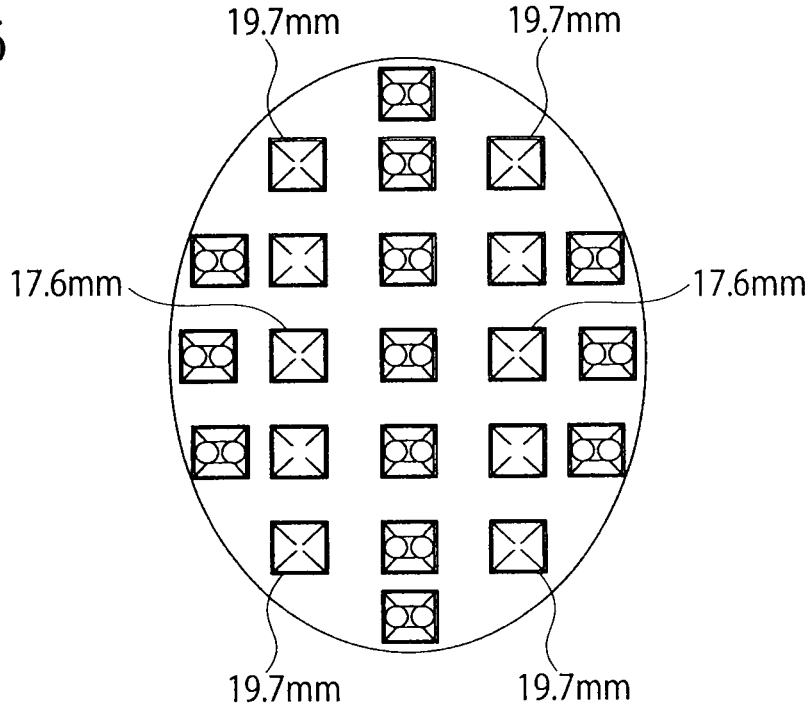
FIG. 56 is a plan view of the bottom board showing the arrangement of two types of conical projections (projection for scraping off skin oil) having different heights used in Comparative Example 2.
Figure 57:
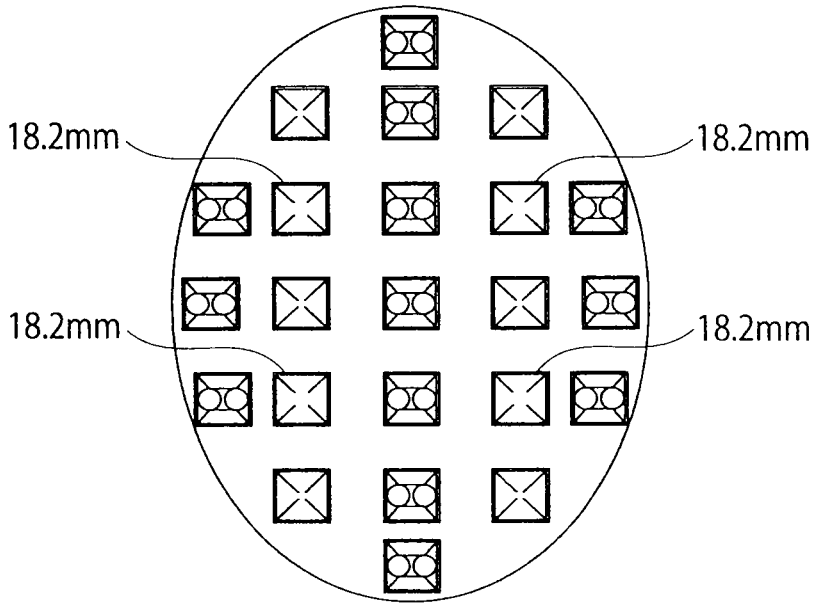
FIG. 57 is a plan view of the bottom board showing the arrangement of the conical projections (projection for massaging) used in Comparative Example 2.

The projection for washing shown in FIG. 41 was used. The root portion of this projection (height of 4.5 mm) is formed into a square shape in cross-section. The configuration from a side of the root portion to a side of the middle portion changes from a square shape in cross-section to a flattened shape (an oval shape) in cross-section. In this comparative example, the height of each tip of the tip projections of the respective projections for washing located at the outer side is higher (21 mm from the brush surface) than the height of each tip of the tip projections of the respective projections for washing located at the inner side (17 mm from the brush surface) in each row in the same manner as Example 1. The arrangement of the lowest projection and the highest projections in each row is the same as Example 1 (refer to FIG. 55). The projections for scraping off skin oil used in this example were formed into a square pyramid shape in such a manner that the tips of the projections were chamfered to have a curved surface as shown in FIG. 45 (the two types of projections having different heights C, 19.7 mm and 17.6 mm, from the brush surface to the tip of each projection were used as in the case of Example 1). The projections for massaging used in this example were formed into a square pyramid shape in such a manner that the tips of the projections were chamfered to have a curved surface as shown in FIG. 46. The arrangement of the respective projections is also the same as Example 1 (refer to FIGS. 56 and 57).

<Evaluation Result>

As shown in FIG. 61, the average evaluation of the scalp washing brush used in Comparative Example 2 was 4.3 points (on a scale of one to ten).

Comparative Example 3

Figure 42:
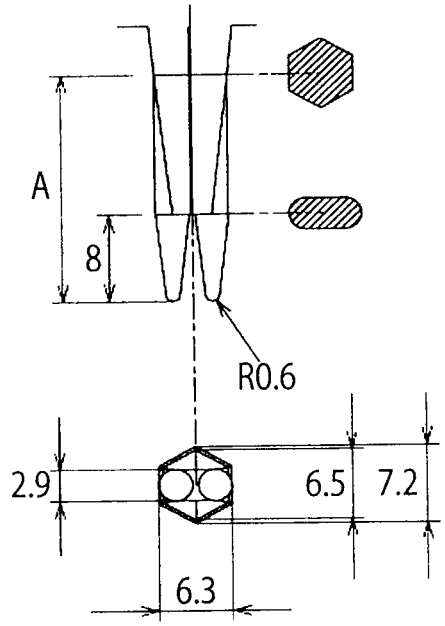
FIG. 42 shows a side view, a plan view and a cross-sectional view of a projection for washing of Comparative Example 3 corresponding to the projection for washing of Example 1.
Figure 47:
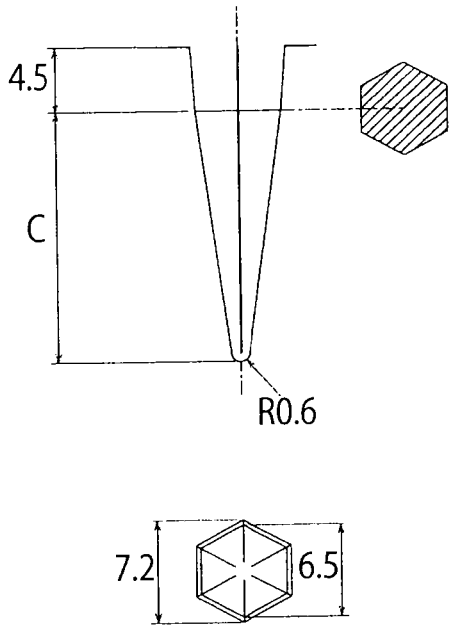
FIG. 47 shows a side view, a plan view and a cross-sectional view of a projection of Comparative Example 3 corresponding to the projection for scraping off skin oil of Example 1.
Figure 48:
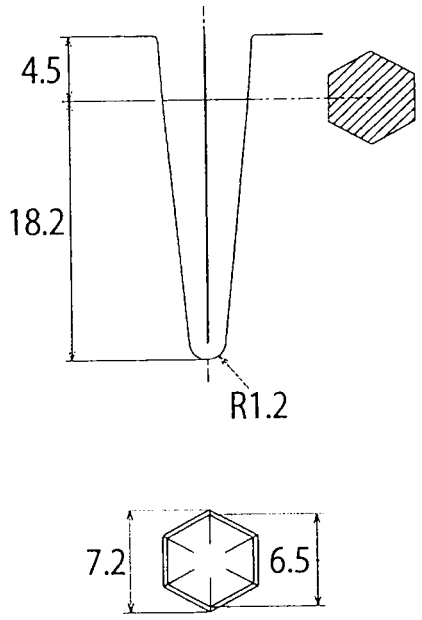
FIG. 48 shows a side view, a plan view and a cross-sectional view of the projection of Comparative Example 3 corresponding to the projection for massaging of Example 1.

The same scalp washing brush as Example 1 was used except for the bottom board in FIG. 38, the projection for washing in FIG. 42, the projection for scraping off skin oil in FIG. 47 and the projection for massaging in FIG. 48, and the evaluation thereof was carried out. The material of the bottom board, the largest long diameter and the largest short diameter in this example are the same as Example 1.

Figure 58:
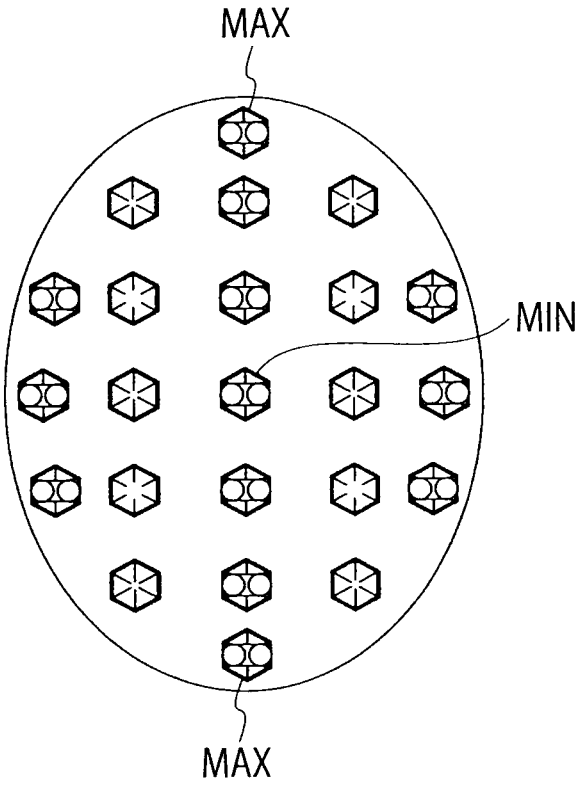
FIG. 58 is a plan view of the bottom board of Comparative Example 3.
Figure 59:
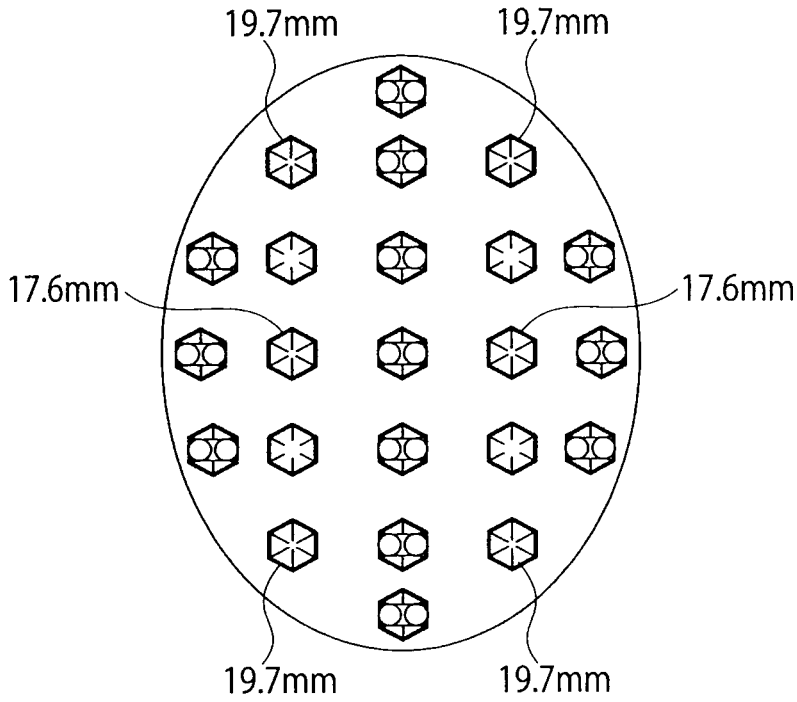
FIG. 59 is a plan view of the bottom board showing the arrangement of two types of conical projections (projection for scraping off skin oil) having different heights used in Comparative Example 3.
Figure 60:
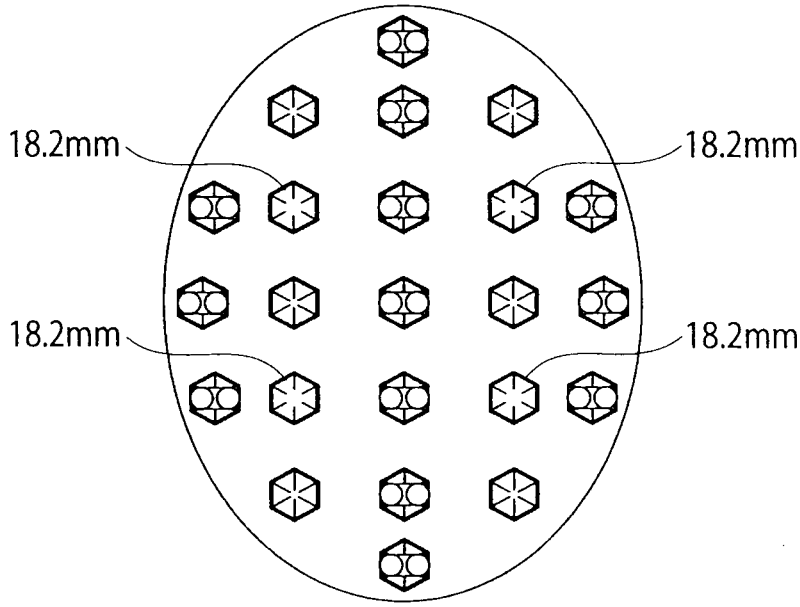
FIG. 60 is a plan view of the bottom board showing the arrangement of the conical projections (projection for massaging) used.

The projection for washing shown in FIG. 42 was used. The root portion of this projection (height of 4.5 mm) is formed into a regular hexagonal shape in cross-section. The configuration from a side of the root portion to a side of the middle portion changes from a regular hexagonal shape in cross-section to a flattened shape (an oval shape) in cross-section. In this comparative example, the height of each tip of the tip projections of the respective projections for washing located at the outer side is higher (21 mm from the brush surface) than the height of each tip of the tip projections of the respective projections for washing located at the inner side (17 mm from the brush surface) in each row in the same manner as Example 1. The arrangement of the lowest projection and the highest projections in each row is the same as Example 1 (refer to FIG. 58). The projections for scraping off skin oil used in this example were formed into a six-sided pyramid shape in such a manner that the tips of the projections were chamfered to have a curved surface as shown in FIG. 47 (the two types of projections having different heights C, 19.7 mm and 17.6 mm, from the brush surface to the tip of each projection were used). The projections for massaging used in this example were formed into a six-sided pyramid shape in such a manner that the tips of the projections were chamfered to have a curved surface as shown in FIG. 48. The arrangement of the respective projections is also the same as Example 1 (refer to FIGS. 59 and 60).

<Evaluation Result>

As shown in FIG. 61, the average evaluation of the scalp washing brush used in Comparative Example 3 was 6.5 points (on a scale of one to ten).

As shown in FIG. 61, the scalp washing brush 10 employing the projections for washing 41 in Example 1 in which the configuration from a side of the root portion to a side of the middle portion of each projection changes from a circular shape in cross-section to a flattened shape (an oval shape) in cross-section resulted in the highest evaluation.

The invention claimed is:

1. A scalp washing device comprising:

a base; and projections for washing, which are made of elastomer resin, and projected which project from a brush surface of the base, wherein each of the projections includes, in a projection direction that extends away from the brush surface towards a tip of a projection:

a root portion having a circular shape in cross-section that is provided at the brush surface, and a middle portion having a flattened shape in cross-section, such that the middle portion has a cross-sectional shape that changes from a circular shape to a flattened shape in the projection direction, the flattened shape defined as an elliptical shape in cross-section that includes:

one or more curved edges, or one or more curved edges and one or more straight edges.

2. The scalp washing device according to claim 1, wherein each of the projections includes a conical tip projection having a tip chamfered to have a curved surface and provided on the middle portion, past the flattened shape in the projection direction.

3. The scalp washing device according to claim 2, wherein the projections are arranged in plural and parallel at intervals from a center of the brush surface of the base toward a periphery of the base, and a height of the projections at the tip projections located at an outer side of each row of the projections, proximate the periphery of the base, is higher than a height of the projections at the tip projections located at an inner side of each row of the projections, proximate the center of the brush surface.

4. The scalp washing device according to claim 3, wherein the projections are projections for washing, the scalp washing device further comprising projections for scraping off skin oil and projections for massaging alternately arranged between the projections of the respective rows.

5. The scalp washing device according to claim 1, wherein the base includes a base body having a handle, and a base plate having through-holes and attached to an opening formed on a side of a bottom of the base body, the projections are provided on a bottom board sandwiched between the base body and the base plate, the root portions of the projections are configured to be inserted into the corresponding through-holes of the base plate, and the projections are projected beyond a lower surface of the base plate.

6. The scalp washing device according to claim 5, wherein the bottom board is made of elastomer resin, and the projections are integrally formed on the bottom board.

7. The scalp washing device according to claim 5, wherein the handle has a flat portion at a rear end of the handle and is provided to form an eave shape via a pillar portion from one end to a middle of an upper surface of the base body defining a curved convex surface, and the base body has a flat portion formed at another end of the upper surface.

8. The scalp washing device according to claim 7, wherein the flat portion at the another end of the upper surface of the base body is formed directly on the upper surface.

9. The scalp washing device according to claim 7, wherein the base body has a projecting portion formed at the another end of the upper surface, and the flat portion at the another end of the upper surface of the base body is formed on the projecting portion.

10. The scalp washing device according to claim 1, wherein the flattened shape is defined as including, in cross-section, two opposing straight edges separated at by two opposing semi-circular edges.

11. The scalp washing device according to claim 1, wherein each of the projections includes two conical tip projections, each having a tip chamfered to have a curved surface and provided on the middle portion, past the flattened shape in the projection direction.

* * * * *